US011634956B2

(12) United States Patent
Mulhern et al.

(10) Patent No.: US 11,634,956 B2
(45) **Date of Patent: *Apr. 25, 2023**

(54) DETONATION ACTIVATED WIRELINE RELEASE TOOL

(71) Applicant: DynaEnergetics Europe GmbH, Troisdorf (DE)

(72) Inventors: Eric Mulhern, Edmonton (CA); Thilo Scharf, Letterkenny (IE)

(73) Assignee: DynaEnergetics Europe GmbH, Troisdorf (DE)

( * ) Notice: Subject to any disclaimer, the term of this patent is extended or adjusted under 35 U.S.C. 154(b) by 36 days.

This patent is subject to a terminal disclaimer.

(21) Appl. No.: 17/201,093

(22) Filed: Mar. 15, 2021

(65) Prior Publication Data

US 2021/0198964 A1 Jul. 1, 2021

Related U.S. Application Data

(63) Continuation of application No. 16/379,341, filed on Apr. 9, 2019, now Pat. No. 11,021,923.

(Continued)

(51) Int. Cl.
*E21B 23/14* (2006.01)
*E21B 23/04* (2006.01)

(Continued)

(52) U.S. Cl.
CPC ..... *E21B 23/04* (2013.01); *E21B 23/0414* (2020.05); *E21B 23/10* (2013.01); *E21B 23/14* (2013.01); *E21B 43/119* (2013.01)

(58) Field of Classification Search
CPC ..... E21B 23/14; E21B 23/04; E21B 23/10
See application file for complete search history.

(56) References Cited

U.S. PATENT DOCUMENTS 1,757,288 A 5/1930 Bleecker
2,228,873 A 1/1941 Hardt et al.

(Continued)

FOREIGN PATENT DOCUMENTS

CA 2003166 A1 5/1991
CA 2821506 A1 1/2015

(Continued)

OTHER PUBLICATIONS

GB Intellectual Property Office; Notification of Grant for GB Appl. No. 1717516.7; dated Oct. 9, 2018; 2 pages.

(Continued)

*Primary Examiner* — Blake Michener
*Assistant Examiner* — Yanick A Akaragwe
(74) *Attorney, Agent, or Firm* — Moyles IP, LLC

(57) ABSTRACT

A detonator activated wireline release tool is provided for use in geological well operations that enables the wireline cable to be easily released from tool string equipment upon activation of a detonator housed within the release tool. The release tool has a wireline subassembly portion that is connected to a tool string subassembly portion during assembly. It is sometimes necessary to disconnect the wireline subassembly from the tool string subassembly at a time when accessing the either is not physically possible. Such release is achieved by sending an electronic signal that detonates an explosive load which actuates a latch through an expansion chamber. The latch shifts and allows the finger flanges previously connecting the subassemblies to disengage, thus releasing the subassemblies.

18 Claims, 16 Drawing Sheets

Related U.S. Application Data

(60) Provisional application No. 62/663,629, filed on Apr. 27, 2018.

(51) Int. Cl.
*E21B 43/119* (2006.01)
*E21B 23/10* (2006.01)

(56) References Cited

U.S. PATENT DOCUMENTS 2,264,450 A 12/1941 Mounce
2,326,406 A 8/1943 Lloyd
2,358,466 A 9/1944 Miller
2,519,116 A 8/1950 Crake
2,543,814 A 3/1951 Thompson et al.
2,598,651 A 5/1952 Spencer
2,621,744 A 12/1952 Toelke
2,637,402 A 5/1953 Baker et al.
2,640,547 A 6/1953 Baker et al.
2,649,046 A 8/1953 Oliver
2,655,993 A 10/1953 Lloyd
2,692,023 A 10/1954 Conrad
2,696,258 A 12/1954 Greene
2,708,408 A 5/1955 Sweetman
2,742,856 A 4/1956 Fieser et al.
2,761,384 A 9/1956 Sweetman
2,766,690 A 10/1956 Lebourg
2,873,675 A 2/1959 Lebourg
2,906,339 A 9/1959 Griffin
2,996,591 A 8/1961 Thomas
3,040,659 A 6/1962 Mcculleugh
3,080,005 A 3/1963 Porter
3,128,702 A 4/1964 Christopher
3,155,164 A 11/1964 Keener
RE25,846 E 8/1965 Campbell
3,209,692 A 10/1965 George
3,211,093 A 10/1965 Mccullough et al.
3,264,989 A 8/1966 Rucker
3,320,884 A 5/1967 Kowalick et al.
3,327,792 A 6/1967 Boop
3,414,071 A 12/1968 Alberts
3,415,321 A 12/1968 Venghiattis
3,621,916 A 11/1971 Smith, Jr.
3,650,212 A 3/1972 Bauer
3,659,658 A 5/1972 Brieger
3,859,921 A 1/1975 Stephenson
4,034,673 A 7/1977 Schneider, Jr.
4,071,096 A 1/1978 Dines
4,080,898 A 3/1978 Gieske
4,084,147 A 4/1978 Mlyniec et al.
4,085,397 A 4/1978 Yagher
4,132,171 A 1/1979 Pawlak et al.
4,208,966 A 6/1980 Hart
4,216,721 A 8/1980 Marziano et al.
4,261,263 A 4/1981 Coultas et al.
4,284,235 A 8/1981 Diermayer et al.
4,306,628 A 12/1981 Adams, Jr. et al.
4,319,526 A 3/1982 DerMott
4,345,646 A 8/1982 Terrell
4,387,773 A 6/1983 McPhee
4,393,946 A 7/1983 Pottier et al.
4,430,939 A 2/1984 Harrold
4,523,649 A 6/1985 Stout
4,541,486 A 9/1985 Wetzel et al.
4,574,892 A 3/1986 Grigar et al.
4,576,233 A 3/1986 George
4,583,602 A 4/1986 Ayers
4,605,074 A * 8/1986 Barfield ..... E21B 43/1195 166/317
4,619,320 A 10/1986 Adnyana et al.
4,620,591 A 11/1986 Terrell et al.
4,640,354 A 2/1987 Boisson
4,643,097 A 2/1987 Chawla et al.
4,756,363 A * 7/1988 Lanmon, II ..... E21B 17/06 175/4.56
4,766,813 A 8/1988 Winter et al.
4,776,393 A 10/1988 Forehand et al.
4,796,708 A 1/1989 Lembcke
4,859,196 A 8/1989 Durando et al.
5,027,708 A 7/1991 Gonzalez et al.
5,060,573 A 10/1991 Montgomery et al.
5,070,788 A 12/1991 Carisella et al.
5,088,413 A 2/1992 Huber
5,090,324 A 2/1992 Bocker et al.
5,105,742 A 4/1992 Sumner
5,119,729 A 6/1992 Nguyen
5,155,296 A 10/1992 Michaluk
5,165,489 A 11/1992 Langston
5,204,491 A 4/1993 Aureal et al.
5,216,197 A 6/1993 Huber et al.
5,347,929 A 9/1994 Lerche et al.
5,366,013 A 11/1994 Edwards et al.
5,398,753 A 3/1995 Obrejanu et al.
5,479,860 A 1/1996 Ellis
5,501,606 A 3/1996 Oda et al.
5,503,077 A 4/1996 Motley
5,551,346 A 9/1996 Walters et al.
5,551,520 A 9/1996 Bethel et al.
5,571,986 A 11/1996 Snider et al.
5,756,926 A 5/1998 Bonbrake et al.
5,778,979 A 7/1998 Burleson et al.
5,803,175 A 9/1998 Myers, Jr. et al.
5,823,266 A 10/1998 Burleson et al.
5,859,383 A 1/1999 Davison et al.
5,911,277 A 6/1999 Hromas et al.
5,984,006 A 11/1999 Read et al.
5,992,523 A 11/1999 Burleson et al.
6,032,733 A 3/2000 Ludwig et al.
6,085,659 A 7/2000 Beukes et al.
6,295,912 B1 10/2001 Burleson et al.
6,349,767 B2 2/2002 Gissler
6,354,374 B1 3/2002 Edwards et al.
6,418,853 B1 7/2002 Duguet et al.
6,431,269 B1 8/2002 Post et al.
6,618,237 B2 9/2003 Eddy et al.
6,651,747 B2 11/2003 Chen et al.
6,675,896 B2 1/2004 George
6,719,061 B2 4/2004 Muller et al.
6,742,602 B2 6/2004 Trotechaud
6,966,378 B2 11/2005 Hromas et al.
7,017,672 B2 3/2006 Owen, Sr.
7,193,527 B2 3/2007 Hall
7,237,626 B2 7/2007 Gurjar et al.
7,278,491 B2 10/2007 Scott
7,347,278 B2 3/2008 Lerche et al.
7,373,974 B2 5/2008 Connell et al.
7,387,162 B2 6/2008 Mooney, Jr. et al.
7,568,429 B2 8/2009 Hummel et al.
7,762,172 B2 7/2010 Li et al.
7,778,006 B2 8/2010 Stewart et al.
7,810,430 B2 10/2010 Chan et al.
7,823,508 B2 11/2010 Anderson et al.
7,845,431 B2 12/2010 Eriksen et al.
7,901,247 B2 3/2011 Ring
7,929,270 B2 4/2011 Hummel et al.
7,934,453 B2 5/2011 Moore
8,069,789 B2 12/2011 Hummel et al.
8,074,737 B2 * 12/2011 Hill ..... E21B 47/12 175/4.6
8,091,477 B2 1/2012 Brooks et al.
8,141,639 B2 3/2012 Gartz et al.
8,157,022 B2 4/2012 Bertoja et al.
8,230,932 B2 7/2012 Ratcliffe et al.
8,256,337 B2 9/2012 Hill
8,264,814 B2 9/2012 Love et al.
8,281,851 B2 10/2012 Spence
8,322,413 B2 12/2012 Bishop et al.
8,322,426 B2 12/2012 Wright et al.
8,395,878 B2 3/2013 Stewart et al.
8,468,944 B2 6/2013 Givens et al.
8,479,830 B2 7/2013 Denoix et al.
D689,590 S 9/2013 Brose
8,540,021 B2 9/2013 McCarter et al.
8,576,090 B2 11/2013 Lerche et al.

(56) References Cited

U.S. PATENT DOCUMENTS

| | | | |
|---|---|---|---|
| 8,689,868 | B2 | 4/2014 | Lerche et al. |
| 8,752,650 | B2 | 6/2014 | Gray |
| 8,875,787 | B2 | 11/2014 | Tassaroli |
| 8,875,796 | B2 | 11/2014 | Hales et al. |
| 8,884,778 | B2 | 11/2014 | Lerche et al. |
| 8,960,093 | B2 | 2/2015 | Preiss et al. |
| 8,991,489 | B2 | 3/2015 | Redlinger et al. |
| 9,175,553 | B2 | 11/2015 | Mccann et al. |
| 9,270,051 | B1 | 2/2016 | Christiansen et al. |
| 9,494,021 | B2 | 11/2016 | Parks et al. |
| 9,523,271 | B2 | 12/2016 | Bonavides et al. |
| 9,587,439 | B2 | 3/2017 | Lamik-Thonhauser et al. |
| 9,598,942 | B2 | 3/2017 | Wells et al. |
| 9,605,937 | B2 | 3/2017 | Eitschberger et al. |
| 9,702,680 | B2 | 7/2017 | Parks et al. |
| 9,709,373 | B2 | 7/2017 | Hikone et al. |
| 9,822,596 | B2 | 11/2017 | Clemens et al. |
| 9,822,618 | B2 | 11/2017 | Eitschberger |
| 9,890,604 | B2 | 2/2018 | Wood et al. |
| 9,909,376 | B2 | 3/2018 | Hrametz et al. |
| 10,100,612 | B2 | 10/2018 | Lisowski et al. |
| 10,188,990 | B2 | 1/2019 | Burmeister et al. |
| 10,309,199 | B2 | 6/2019 | Eitschberger |
| 10,429,161 | B2 | 10/2019 | Parks et al. |
| 10,472,938 | B2 | 11/2019 | Parks et al. |
| 10,594,102 | B2 | 3/2020 | Pratt et al. |
| 10,669,822 | B2 | 6/2020 | Eitschberger |
| 10,689,931 | B2 | 6/2020 | Mickey et al. |
| 10,794,122 | B2 | 10/2020 | Kitchen et al. |
| 11,136,866 | B2 | 10/2021 | Holodnak et al. |
| 11,306,547 | B2 | 4/2022 | Thomas |
| 2003/0001753 | A1 | 1/2003 | Cernocky et al. |
| 2004/0141279 | A1 | 7/2004 | Amano et al. |
| 2006/0082152 | A1 | 4/2006 | Neves |
| 2007/0084336 | A1 | 4/2007 | Neves |
| 2007/0158071 | A1 | 7/2007 | Mooney et al. |
| 2008/0173240 | A1 | 7/2008 | Furukawahara et al. |
| 2012/0006217 | A1 | 1/2012 | Anderson |
| 2012/0094553 | A1 | 4/2012 | Fujiwara et al. |
| 2012/0247769 | A1 | 10/2012 | Schacherer et al. |
| 2013/0112396 | A1 | 5/2013 | Splittstoeßer |
| 2013/0168083 | A1 | 7/2013 | McCarter et al. |
| 2014/0008071 | A1 | 1/2014 | Patterson et al. |
| 2014/0033939 | A1 | 2/2014 | Priess et al. |
| 2014/0148044 | A1 | 5/2014 | Balcer et al. |
| 2014/0166370 | A1 | 6/2014 | Silva |
| 2016/0061572 | A1 | 3/2016 | Eitschberger et al. |
| 2016/0168961 | A1 | 6/2016 | Parks et al. |
| 2016/0202033 | A1 | 7/2016 | Shahinpour et al. |
| 2016/0356132 | A1 | 12/2016 | Burmeister et al. |
| 2017/0030693 | A1 | 2/2017 | Preiss et al. |
| 2017/0052011 | A1 | 2/2017 | Parks et al. |
| 2017/0074078 | A1 | 3/2017 | Eitschberger |
| 2017/0226814 | A1 | 8/2017 | Clemens et al. |
| 2017/0276465 | A1 | 9/2017 | Parks et al. |
| 2017/0314373 | A9 | 11/2017 | Bradley et al. |
| 2017/0328160 | A1 | 11/2017 | Arnaly |
| 2018/0038208 | A1 | 2/2018 | Eitschberger et al. |
| 2018/0202789 | A1 | 7/2018 | Parks et al. |
| 2018/0202790 | A1 | 7/2018 | Parks et al. |
| 2018/0318770 | A1 | 11/2018 | Eitschberger et al. |
| 2018/0347324 | A1 | 12/2018 | Langford et al. |
| 2019/0219375 | A1 | 7/2019 | Parks et al. |
| 2019/0242222 | A1 | 8/2019 | Eitschberger |
| 2019/0338612 | A1 | 11/2019 | Holodnak et al. |
| 2019/0366272 | A1 | 12/2019 | Eitschberger et al. |
| 2020/0032602 | A1 | 1/2020 | Jennings et al. |
| 2020/0032626 | A1 | 1/2020 | Parks et al. |
| 2020/0056442 | A1 | 2/2020 | Cherewyk et al. |
| 2020/0095838 | A1 | 3/2020 | Baker |
| 2020/0199983 | A1 | 6/2020 | Preiss et al. |
| 2020/0248536 | A1 | 8/2020 | Holodnak et al. |

FOREIGN PATENT DOCUMENTS

| | | | |
|---|---|---|---|
| CA | 2824838 | A1 | 2/2015 |
| CA | 2941648 | A1 | 9/2015 |
| CN | 2821154 | | 9/2006 |
| CN | 1965148 | A | 5/2007 |
| CN | 101397890 | A | 4/2009 |
| CN | 101435829 | A | 5/2009 |
| CN | 101454635 | A | 6/2009 |
| CN | 209908471 | U | 1/2020 |
| EP | 0088516 | A1 | 9/1983 |
| EP | 0385614 | A2 | 9/1990 |
| EP | 0180520 | B1 | 5/1991 |
| EP | 679859 | A2 | 11/1995 |
| EP | 0482969 | B1 | 8/1996 |
| EP | 694157 | B1 | 8/2001 |
| EP | 2702349 | B1 | 11/2015 |
| GB | 2383236 | B | 1/2004 |
| GB | 2531450 | B | 2/2017 |
| GB | 2548203 | A | 9/2017 |
| RU | 2091567 | C1 | 9/1997 |
| RU | 2211917 | C1 | 9/2003 |
| RU | 2224095 | C1 | 2/2004 |
| RU | 2295694 | C2 | 3/2007 |
| RU | 93521 | U1 | 4/2010 |
| RU | 100552 | U1 | 12/2010 |
| RU | 2434122 | C2 | 11/2011 |
| WO | 9905390 | A1 | 2/1999 |
| WO | 2000020821 | A1 | 4/2000 |
| WO | 0159401 | A1 | 8/2001 |
| WO | 2001059401 | A1 | 8/2001 |
| WO | 2009091422 | A3 | 3/2010 |
| WO | 2012006357 | A3 | 4/2012 |
| WO | 2012140102 | A1 | 10/2012 |
| WO | 2012106640 | A3 | 11/2012 |
| WO | 2012149584 | A1 | 11/2012 |
| WO | 2014046670 | A1 | 3/2014 |
| WO | 2015006869 | A1 | 1/2015 |
| WO | 2015028204 | A2 | 3/2015 |

OTHER PUBLICATIONS

GB Intellectual Property Office; Office Action for GB App. No. 1717516.7; dated Feb. 27, 2018; 6 pages.

GB Intellectual Property Office; Search Report for GB. Appl. No. 1700625.5; dated Dec. 21, 2017; 5 pages.

GE Oil & GAS, Addressable Downhole Release Tools, Mar. 23, 2018, 5 pgs., https://www.bhge.com/upstream/evaluation/wireline-products-and-equipment/downhole-equipment/addressable-downhole-release-tools.

German Patent Office, Office Action for German Patent Application No. 10 2013 109 227.6, which is in the same family as PCT Application No. PCT/EP2014/065752, see p. 5 for references cited, May 22, 2014, 8 pgs.

Gilliat et al.; New Select-Fire System: Improved Reliability and Safety in Select Fire Operations; 2012; 16 pgs.

GR Energy Services, ZipRelease Addressable Wireline Release Tool, Dec. 8, 2016, 2 pgs.,https://grenergyservices.com/completion-services/perforating/addressable-wireline-release.

Halliburton, Releasable Cable Heads, 1 pg., Mar. 23, 2018, https://www.halliburton.com/en-US/ps/wireline-perforating/wireline-and-perforating/deployment-risk-avoidance/releasable-wireline-cable-head-rwch-tool html.

Halliburton, Releasable Wireline Cable Head (RWCH Tool), 2016, 2 pgs., https://www.halliburton.com/content/dam/ps/public/lp/contents/Data_Sheets/web/H/Releasable-Wireline-Cable-Head-Tool-RWCH.pdf.

Hunting Energy Service,ControlFire RF Safe ControlFire® RF-Safe Manual, 33 pgs., Jul. 2016, http://www.hunting-intl.com/media/2667160/ControlFire%20RF_Assembly%20Gun%20Loading_Manual.pdf.

Hunting Titan Division, Marketing White Paper: H-1® Perforating Gun System, Jan. 2017, 5 pgs., http://www.hunting-intl.com/media/2674690/White%20Paper%20-%20H-1%20Perforating%20Gun%20Systems_January%202017.pdf.

(56) References Cited

OTHER PUBLICATIONS

Hunting Titan Inc.; Petition for Post Grant Review of U.S. Pat. No. 10,429,161; dated Jun. 30, 2020; 109 pages.
Hunting Titan Inc.; Petition for Post Grant Review of U.S. Pat. No. 10,472,938; dated Aug. 12, 2020; 198 pages.
Hunting Titan Ltd,; Defendants' Answer and Counterclaims, Civil Action No. 4:19-cv-01611, consolidated to Civil Action No. 4:17-cv-03784; dated May 28, 2019; 21 pages.
Hunting Titan Ltd.; Petition for Inter Partes Review of U.S. Pat. No. 9,581,422 Case No. IPR2018-00600; dated Feb. 16, 2018; 93 pages.
Hunting Titan Ltd.; Defendants' Answer and Counterclaims, Civil Action No. 6:20-cv-00069; dated Mar. 17, 2020; 30 pages.
Hunting Titan Ltd.; Defendants' Answer to First Amended Complaint and Counterclaims, Civil Action No. 6:20-cv-00069; dated Apr. 6, 2020; 30 pages.
Hunting Titan Ltd.; Defendants' Answer to Second Amended Complaint and Counterclaims, Civil Action No. 6:20-cv-00069; dated May 12, 2020; 81 pages.
Hunting Titan Ltd.; Defendants Invalidity Contentions Pursuant to Patent Rule 3-3, Civil Action No. 4:17-cv-03784; dated Jul. 6, 2018; 29 pages.
Hunting Titan Ltd.; Defendants' Objections and Responses to Plaintiffs' First Set of Interrogatories, Civil Action No. 4:17-cv-03784; dated Jun. 11, 2018.
Hunting Titan Ltd.; Defendants' Opposition to Plaintiffs' Motion to Dismiss and Strike Defendants' Amended Counterclaim and Affirmative Defenses for Unenforceability due to Inequitable Conduct for Civil Action No. 4:17-cv-03784; dated Apr. 24, 2018; 8 pages.
Hunting Titan, H-1 Perforating System, Sep. 1, 2017, 3 pgs., http://www.hunting-intl.com/titan/perforating-guns-and-setting-tools/h-1%C2%AE-perforating-system.
Hunting Titan, Wireline Top Fire Detonator Systems, Nov. 24, 2014, 2 pgs, http://www.hunting-intl.com/titan/perforating-guns-and-setting-tools/wireline-top-fire-detonator-systems.
Hunting Titan; ControlFire RF-Safe Assembly Gun Loading Manual; 33 pages.
Hunting Titan; ControlFire User Manual; 2014; 56 pages.
Hunting Titan; Resilience Against Market Volatility Results Presentation; dated Jun. 30, 2020; 26 pages.
Hunting Titan; Response to Canadian Office Action for CA App. No. 2,933,756; dated Nov. 23, 2017; 18 pages.
Industrial Property Office, Czech Republic; Office Action for CZ App. No. PV 2017-675; dated Jul. 18, 2018; 2 pages; Concise Statement of Relevance: Examiner's objection of CZ application claims 1, 7, and 16 based on US Pub No. 20050194146 alone or in combination with WO Pub No. 2001059401.
Industrial Property Office, Czech Republic; Office Action for CZ App. No. PV 2017-675; dated Oct. 26, 2018; 2 pages.
Industrial Property Office, Czech Republic; Office Action; CZ App. No. PV 2017-675; dated Dec. 17, 2018; 2 pages.
Instituto Nacional De La Propiedad Industrial; Office Action for AR Appl. No. 20140102653; dated May 9, 2019 (1 page).
Intellectual Property India, Office Action of IN Application No. 201647004496, dated Jun. 7, 2019, 6 pgs.
International Searching Authority, International Preliminary Report on Patentability for PCT App. No. PCT/EP2014/065752; dated Mar. 1, 2016, 10 pgs.
International Searching Authority; Communication Relating to the Results of the Partial International Search for PCT/EP2020/070291; dated Oct. 20, 2020; 8 pages.
International Searching Authority; International Preliminary Report on Patentability for PCT Appl. No. PCT/CA2014/050673; dated Jan. 19, 2016; 5 pages.
International Searching Authority; International Search Report and Written Opinion for PCT App. No. PCT/CA2014/050673; dated Oct. 9, 2014; 7 pages.
International Searching Authority; International Search Report and Written Opinion for PCT App. No. PCT/EP2015/059381; dated Nov. 23, 2015; 14 pages.
International Searching Authority; International Search Report and Written Opinion for PCT App. No. PCT/US2015/018906; dated Jul. 10, 2015; 12 pages.
Jet Research Center Inc., JRC Catalog, 2008, 36 pgs., https://www.jetresearch.com/content/dam/jrc/Documents/Books_Catalogs/06_Dets.pdf.
Jet Research Center Inc., Red RF Safe Detonators Brochure, 2008, 2 pages, www.jetresearch.com.
Jet Research Centers, Capsule Gun Perforating Systems, Alvarado, Texas, 26 pgs., https://www.jetresearch.com/content/dam/jrc/Documents/Books_Catalogs/07_Cap_Gun.pdf.
Mcnelis et al.; High-Performance Plug-and-Perf Completions in Unconventional Wells; Society of Petroleum Engineers Annual Technical Conference and Exhibition; Sep. 28, 2015.
Norwegian Industrial Property Office; Office Action and Search Report for NO App. 20160017; dated Jun. 15, 2017; 5 pages.
Norwegian Industrial Property Office; Office Action and Search Report for NO App. No. 20171759; Jan. 14, 2020; 6 pages.
Norwegian Industrial Property Office; Office Action for NO Appl. No. 20160017; dated Dec. 4, 2017; 2 pages.
Norwegian Industrial Property Office; Office Action for NO Appl. No. 20171759; dated Oct. 30, 2020; 2 pages.
Norwegian Industrial Property Office; Opinion for NO Appl. No. 20171759; dated Apr. 5, 2019; 1 page.
Owen Oil Tools & Pacific Scientific; RF-Safe Green Det, Side Block for Side Initiation, Jul. 26, 2017, 2 pgs.
Parrot, Robert; Declaration, PGR 2020-00080; dated Aug. 11, 2020; 400 pages.
Patent Trial and Appeal Board; Decision Granting Patent Owner's Request for Rehearing and Motion to Amend for IPR2018-00600; dated Jul. 6, 2020; 27 pages.
DynaEnergetics, DYNAselect Electronic Detonator 0015 TFSFDE RDX 1.4B, Product Information, Apr. 23, 2015, 1 pg.
United States Patent and Trademark Office, Office Action of U.S. Appl. No. 15/788,367, dated Oct. 22, 2018, 6 pgs.
United States Patent and Trademark Office, Office Action of U.S. Appl. No. 15/920,800, dated Dec. 27, 2019, 6 pgs.
United States Patent and Trademark Office, Office Action of U.S. Appl. No. 15/920,812, dated Dec. 27, 2019, 6 pgs.
United States Patent and Trademark Office, Office Action of U.S. Appl. No. 15/920,812, dated May 27, 2020, 5 pgs.
United States Patent and Trademark Office, Office Action of U.S. Appl. No. 16/026,431, dated Jul. 30, 2019, 10 pgs.
United States Patent and Trademark Office, Office Action of U.S. Appl. No. 16/359,540, dated Aug. 14, 2019, 9 pgs.
United States Patent and Trademark Office, Office Action of U.S. Appl. No. 16/359,540, dated May 3, 2019, 11 pgs.
United States Patent and Trademark Office, Office Action of U.S. Appl. No. 16/540,484, dated Oct. 4, 2019, 12 pgs.
United States Patent and Trademark Office, Office Action of U.S. Appl. No. 16/585,790, dated Nov. 12, 2019, 9 pgs.
United States Patent and Trademark Office, Office Action of U.S. Appl. No. 16/809,729, dated Jun. 19, 2020, 9 pgs.
United States Patent and Trademark Office, Office Action of U.S. Appl. No. 29/733,080, dated Jun. 26, 2020, 8 pgs.
U.S. Appl. No. 61/733,129, filed Dec. 4, 2012; 10 pages.
U.S. Appl. No. 61/819,196, filed May 3, 2013 ; 10 pages.
United States Patent and Trademark Office; Final Office Action of U.S. Appl. No. 16/809,729, dated Nov. 3, 2020; 19 pages.
United States Patent and Trademark Office; Final Office Action of U.S. Appl. No. 16/540,484; dated Mar. 30, 2020; 12 pgs.
United States Patent and Trademark Office; Non-Final Office Action for U.S. Appl. No. 16/379,341; dated Sep. 21, 2020; 15 pages.
United States Patent and Trademark Office; Notice of Allowance for U.S. Appl. No. 29/733,080; dated Oct. 20, 2020; 9 pages.
United States Patent and Trademark Office; Notice of Allowance for U.S. Appl. No. 15/920,812, dated Aug. 18, 2020; 5 pages.
United States Patent and Trademark Office; Notice of Allowance for U.S. Appl. No. 16/387,696; dated Jan. 29, 2020; 7 pages.
United States Patent and Trademark Office; Notice of Allowance for U.S. Appl. No. 16/585,790, dated Aug. 5, 2020; 15 pages.
United States Patent and Trademark Office; Notice of Allowance for U.S. Appl. No. 16/379,341; dated Jan. 19, 2021; 8 pages.

(56) References Cited

OTHER PUBLICATIONS

United States Patent and Trademark Office; Office Action of U.S. Appl. No. 16/540,484, dated Aug. 20, 2020, 10 pgs.
United States Patent and Trademark Office; Restriction Requirement for U.S. Appl. No. 17/007,574; dated Oct. 23, 2020; 6 pages.
United States Patent and Trial Appeal Board; Final Written Decision on IPR2018-00600; issued Aug. 20, 2019; 31 pages.
USPTO, U.S. Pat. No. 438,305A, issued on Oct. 14, 1890 to T.A. Edison, 2 pages.
USPTO; Notice of Allowance for U.S. Appl. No. 14/904,788; dated Jul. 6, 2016; 8 pages.
USPTO; Supplemental Notice of Allowability for U.S. Appl. No. 14/904,788; dated Jul. 21, 2016; 2 pages.
World Oil; DynaEnergetics expands DynaStage factory-assembled, well perforating systems; dated Mar. 14, 2017; 2 pages.
Allied Horizontal Wireline Services, Addressable Disconnect Tool, Mar. 19, 2016, 3 pgs., http://alliedhorizontal.com/wireline-services/cased-hole-services/addressable-disconnect-tool/.
Amit Govil, Selective Perforation: A Game Changer in Perforating Technology—Case Study, presented at the 2012 European and West African Perforating Symposium, Schlumberger, Nov. 7-9, 2012, 14 pgs.
Austin Powder Company; A—140 F & Block, Detonator & Block Assembly; Jan. 5, 2017; 2 pgs.; https://www.austinpowder.com/wp-content/uploads/2019/01/OilStar_A140Fbk-2.pdf.
Baker Hughes, Long Gun Deployment Systems IPS-12-28; 2012 International Perforating Symposium; Apr. 26-27, 2011; 11 pages.
Baker Hughes; SurePerf Rapid Select-Fire System Perforate production zones in a single run; 2012; 2 pages.
Brazilian Patent and Trademark Office; Search Report for BR Application No. BR112015033010-0; dated May 5, 2020; (4 pages).
Canadian Intellectual Property Office, Office Action of CA App. No. 3,040,648, dated Jun. 11, 2020, 4 pgs.
Canadian Intellectual Property Office; Notice of Allowance for CA Appl. No. 2,821,506; dated Jul. 31, 2019; 1 page.
Canadian Intellectual Property Office; Office Action for CA Appl. No. 2,821,506; dated Mar. 21, 2019; 4 pages.
Canadian Intellectual Property Office; Office Action for CA Application No. 3040648; dated Nov. 18, 2020; 4 pages.
Canatex, BRT Ballistic Release Tool, Dec. 13, 2017, 1 pg., https://daks2k3a4ib2z.cloudfront.net/59a43992f0b9de0001da166e/5a31b3b3fd7b9d00016b950a_CTX_BRT_CX17006.X02_13Dec2017.pdf.
Cao et al., Study on energy output efficiency of mild detonating fuse in cylindertube structure, Dec. 17, 2015, 11 pgs., https://www.sciencedirect.com/science/article/pii/S0264127515309345.
DynaEnergetics Europe Gmbh; Patent Owner's Preliminary Response for PGR2020-00072; dated Oct. 23, 2020; 108 pages.
DynaEnergetics Europe Gmbh; Patent Owner's Preliminary Response for PGR2020-00080; dated Nov. 18, 2020; 119 pages.
DynaEnergetics Europe Gmbh; Principal and Response Brief of Cross-Appellant for United States Court of Appeals case No. 2020-2163, -2191; dated Jan. 11, 2021; 95 pages.
DynaEnergetics Europe; Complaint and Demand for Jury Trial, Civil Action No. 6:20-cv-00069; dated Jan. 30, 2020; 9 pages.
DynaEnergetics Europe; Complaint and Demand for Jury Trial,Civil Action No. 4:17-cv-03784; dated Dec. 14, 2017; 7 pages.
DynaEnergetics Europe; DynaEnergetics exhibition and product briefing; 2013; 15 pages.
DynaEnergetics Europe; DynaStage Gun System; May 2014; 2 pages.
DynaEnergetics Europe; Exhibit B Invalidity Claim Chart for Civil Action No. 4:19-cv-01611; dated May 2, 2019; 52 pages.
DynaEnergetics Europe; Exhibit C Invalidity Claim Chart for Civil Action No. 4:17-cv-03784; dated Jul. 13, 2020; 114 pages.
DynaEnergetics Europe; Petition to Correct Inventorship in Patent under 37 C.F.R § 1.324; dated Oct. 13, 2020; 21 pages.
DynaEnergetics Europe; Plaintiffs' Local Patent Rule 3-1 Infringement Contentions for Civil Action No. 4:19-cv-01611; dated May 25, 2018; 10 Pages.
DynaEnergetics Europe; Plaintiffs' Motion to Dismiss Defendants' Counterclaim and to strike Affirmative Defenses, Civil Action No. 4:17-cv-03784; dated Feb. 20, 2018; 9 pages.
DynaEnergetics Europe; Plaintiffs' Preliminary Claim Constructions and Identification of Extrinsic Evidence Civil Action No. 4:17-cv-03784; dated Aug. 3, 2018; 9 pages.
DynaEnergetics Europe; Plaintiffs' Preliminary Infringement Contentions, Civil Action No. 6:20-cv-00069-ADA; dated Apr. 22, 2020; 32 pages.
DynaEnergetics Europe; Plaintiffs' Reply in Support of Motion to Dismiss and Strike for Civil Action No. 6:20-cv-00069-ADA; dated Apr. 29, 2020; 15 pages.
DynaEnergetics Europe; Plaintiffs Response to Defendant Hunting Titan Ins' Inoperative First Amended Answer, Affirmative Defenses, and Counterclaims for Civil Action No. 6:20-cv-00069-ADA; dated May 13, 2020.
DynaEnergetics Europe; Plaintiffs' Response to Defendants' Answer to Second Amended Complaint Civil Action No. 6:20-cv-00069-ADA; dated May 26, 2020; 18 pages.
DynaEnergetics Gmbh & Co. KG, Patent Owner's Response to Hunting Titan's Petition for Inter Parties Review—Case IPR2018-00600, filed Dec. 6, 2018, 73 pages.
DynaEnergetics GmbH & Co. KG; Patent Owner's Precedential Opinion Panel Request for Case IPR2018-00600; Sep. 18, 2019, 2 pg.
DynaEnergetics, DYNAselect Electronic Detonator 0015 SFDE RDX 1.4B, Product Information, Dec. 16, 2011, 1 pg.
DynaEnergetics, DYNAselect Electronic Detonator 0015 SFDE RDX 1.4S, Product Information, Dec. 16, 2011, 1 pg.
DynaEnergetics, DYNAselect System, information downloaded from website, Jul. 3, 2013, 2 pages, http://www.dynaenergetics.com/.
DynaEnergetics, Electronic Top Fire Detonator, Product Information Sheet, Jul. 30, 2013, 1 pg.
DynaEnergetics, Selective Perforating Switch, information downloaded from website, Jul. 3, 2013, 2 pages, http://www.dynaenergetics.com/.
DynaEnergetics, Selective Perforating Switch, Product Information Sheet, May 27, 2011, 1 pg.
DynaEnergetics; DynaStage Solution—Factory Assembled Performance-Assured Perforating Systems; 6 pages.
EP Patent Office—International Searching Authority, PCT Search Report and Written Opinion for PCT Application No. PCT/EP2014/065752, dated May 4, 2015, 12 pgs.
Eric H. Findlay, Jury Trial Demand in Civil Action No. 6:20-cv-00069-ADA, dated Apr. 22, 2020, 32 pages.
European Patent Office; Invitation to Correct Deficiencies noted in the Written Opinion for European App. No. 15721178.0; dated Dec. 13, 2016; 2 pages.
European Patent Office; Office Action for EP App. No. 15721178.0; dated Sep. 6, 2018; 5 pages.
Federal Institute of Industrial Property; Decision of Granting for RU Appl. No. 2016104882/03(007851); dated May 17, 2018; 15 pages (English translation 4 pages).
Federal Institute of Industrial Property; Decision on Granting a Patent for Invention Russian App. No. 2016139136/03(062394); dated Nov. 8, 2018; 20 pages (Eng Translation 4 pages); Concise Statement of Relevance: Search Report at 17-18 of Russian-language document lists several 'A' references based on RU application claims.
Federal Institute of Industrial Property; Inquiry for RU App. No. 2016104882/03(007851); dated Feb. 1, 2018; 7 pages, English Translation 4 pages.
Federal Institute of Industrial Property; Inquiry for RU Application No. 2016110014/03(015803); issued Feb. 1, 2018; 6 pages (Eng. Translation 4 pages).
GB Intellectual Property Office, Examination Report for GB App. No. GB1600085.3, dated Mar. 9, 2016, 1 pg.
GB Intellectual Property Office, Search Report for App. No. GB 1700625.5; dated Jul. 7, 2017; 5 pgs.
GB Intellectual Property Office; Examination Report for GB Appl. No. 1717516.7; dated Apr. 13, 2018; 3 pages.
GB Intellectual Property Office; Notification of Grant for GB Appl. No. 1600085.3; dated Jan. 24, 2017; 2 pages.

(56) References Cited

OTHER PUBLICATIONS

Canadian Intellectual Property Office; Office Action for CA Application No. 3,040,648; dated Jul. 16, 2021; 3 pages.
Hunting Titan, Wireline Hardware, Logging Instruments EBFire, TCB Systems, Gun Systems, Oct. 15, 2015, V.9.1, 72 pgs., http://www.hunting-intl.com/media/1305595/hunting-titan-complete-v9-1.pdf.
PCT Search Report and Written Opinion, dated May 4, 2015: See Search Report and Written opinion for PCT Application No. PCT/EP2014/065752, 12 pgs.
Preiss Frank et al.; Lowering Total Cost of Operations Through Higher Perforating Efficiency while simultaneously enhancing safety; 26 pages.
Robert Parrott, Case IPR2018-00600 for U.S. Pat. No. 9,581,422 B2, Declaration regarding Patent Invalidity, dated Jun. 29, 2020, 146 pages.
Rodgers, John; Declaration for PGR2020-00072; dated Oct. 23, 2020; 116 pages.
Rodgers, John; Declaration for PGR2020-00080; dated Nov. 18, 2020; 142 pages.
Salt Warren et al.; New Perforating Gun System Increases Safety and Efficiency; dated Apr. 1, 2016; 11 pages.
Scharf Thilo; Declaration for PGR2020-00080; dated Nov. 16, 2020; 16 pages.
Scharf, Thilo; Declaration for PGR2020-00072; dated Oct. 22, 2020; 13 pages.
Schlumberger & Said Abubakr, Combining and Customizing Technologies for Perforating Horizontal Wells in Algeria, Presented at 2011 MENAPS, Nov. 28-30, 2011, 20 pages.
Schlumberger, Perforating Services Catalog, 2008, 521 pages.
Schlumberger; Selective Perforation: A Game Changer in Perforating Technology—Case Study; issued 2012; 14 pages.
Sharma, Gaurav; Hunting Plc Is Not In A Race To The Bottom, Says Oilfield Services Firm's CEO; dated Sep. 10, 2019; retrieved on Nov. 18, 2020; 6 pages.
SIPO, Search Report dated Mar. 29, 2017, in Chinese: See Search Report for CN App. No. 201480040456.9, 12 pgs. (English Translation 3 pgs).
Smylie, Tom, New Safe and Secure Detonators for the Industry's consideration, presented at Explosives Safety & Security Conference, Marathon Oil Co, Houston; Feb. 23-24, 2005, 20 pages.
Spears & Associates; Global Wireline Market; dated Oct. 15, 2019; 143 pages.
State Intellectual Property Office People's Republic of China; First Office Action for Chinese App. No. 201811156092.7; dated Jun. 16, 2020; 6 pages (Eng Translation 8 pages).
State Intellectual Property Office, P.R. China; First Office Action for Chinese App No. 201580011132.7; dated Jun. 27, 2018; 5 pages (Eng. Translation 9 pages).
State Intellectual Property Office, P.R. China; First Office Action for CN App. No. 201480047092.7; dated Apr. 24, 2017.
State Intellectual Property Office, P.R. China; First Office Action with full translation for CN App. No. 201480040456.9; dated Mar. 29, 2017; 12 pages (English translation 17 pages).
State Intellectual Property Office, P.R. China; Notification to Grant Patent Right for Chinese App. No. 201580011132.7; dated Apr. 3, 2019; 2 pages (Eng. Translation 2 pages).
State Intellectual Property Office, P.R. China; Notification to Grant Patent Right for CN App. No. 201480040456.9; dated Jun. 12, 2018; 2 pages (English translation 2 pages).
State Intellectual Property Office, P.R. China; Second Office Action for CN App. No. 201480040456.9; dated Nov. 29, 2017; 5 pages (English translation 1 page).
State Intellectual Property Office, P.R. China; Second Office Action for CN App. No. 201480047092.7; dated Jan. 4, 2018; 3 pages.
Thilo Scharf; "DynaEnergetics exhibition and product briefing"; pp. 5-6; presented at 2014 Offshore Technology Conference; May 2014.
Thilo Scharf; "DynaStage & BTM Introduction"; pp. 4-5, 9; presented at 2014 Offshore Technology Conference; May 2014.
Thru-Tubing Systems, Series 1200—Auto Release Tool, 2003, 2 pgs., http://www.thrutubingsystems.com/intervention-products-and-services.php?product=/wireline-products/series-1200-auto-release-tool.
Thru-Tubing Systems, Thru-Tubing Systems Wireline Products Catalog, Apr. 25, 2016, 45 pgs., http://www.thrutubingsystems.com/phire-content/assets/files/Thru%20Tubing%20Systems%20Wireline%20Products.pdf.
U.S. Patent Trial and Appeal Board, Institution of Inter Partes Review of U.S. Pat. No. 9,581,422, Case IPR2018-00600, Aug. 21, 2018, 9 pages.
United States District Court for the Southern District of Texas Houston Division, Case 4:19-cv-01611 for U.S. Pat. No. 9,581,422B2, Defendant's Answers, Counterclaims and Exhibits, dated May 28, 2019, 135 pgs.
United States District Court for the Southern District of Texas Houston Division, Case 4:19-cv-01611 for U.S. Pat. No. 9,581,422B2, Plaintiffs' Motion to Dismiss and Exhibits, dated Jun. 17, 2019, 63 pgs.
United States District Court for the Southern District of Texas Houston Division, Case 4:19-cv-01611 for U.S. Pat. No. 9,581,422B2, Plaintiff's Complaint and Exhibits, dated May 2, 2019, 26 pgs.
United States Patent and Trademark Office, Case IPR2018-00600 for U.S. Pat. No. 9,581,422 B2, Reply In Support of Patent Owner's Motion to Amend, dated Mar. 21, 2019, 15 pgs.
United States Patent and Trademark Office, Case IPR2018-00600 for U.S. Pat. No. 9,581,422 B2, Decision of Precedential Opinion Panel, Granting Patent Owner's Request for Hearing and Granting Patent Owner's Motion to Amend, dated Jul. 6, 2020, 27 pgs.
United States Patent and Trademark Office, Case IPR2018-00600 for U.S. Pat. No. 9,581,422 B2, DynaEnergetics GmbH & Co. KG's Patent Owner Preliminary Response, dated May 22, 2018, 47 pgs.
United States Patent and Trademark Office, Case IPR2018-00600 for U.S. Pat. No. 9,581,422 B2, Order Granting Precedential Opinion Panel, Paper No. 46, dated Nov. 7, 2019, 4 pgs.
United States Patent and Trademark Office, Case IPR2018-00600 for U.S. Pat. No. 9,581,422 B2, Patent Owner's Motion to Amend, dated Dec. 6, 2018, 53 pgs.
United States Patent and Trademark Office, Case IPR2018-00600 for U.S. Pat. No. 9,581,422 B2, Patent Owner's Opening Submission to Precedential Opinion Panel, dated Dec. 20, 2019, 21 pgs.
United States Patent and Trademark Office, Case IPR2018-00600 for U.S. Pat. No. 9,581,422 B2, Patent Owner's Request for Hearing, dated Sep. 18, 2019, 19 pgs.
United States Patent and Trademark Office, Case IPR2018-00600 for U.S. Pat. No. 9,581,422 B2, Patent Owner's Responsive Submission to Precedential Opinion Panel, dated Jan. 6, 2020, 16 pgs.
United States Patent and Trademark Office, Case IPR2018-00600 for U.S. Pat. No. 9,581,422 B2, Patent Owner's Sur-reply, dated Mar. 21, 2019, 28 pgs.
United States Patent and Trademark Office, Case IPR2018-00600 for U.S. Pat. No. 9,581,422 B2, Petitioner's Additional Briefing to the Precedential Opinion Panel, dated Dec. 20, 2019, 23 pgs.
United States Patent and Trademark Office, Case IPR2018-00600 for U.S. Pat. No. 9,581,422 B2, Petitioner's Opposition to Patent Owner's Motion to Amend, dated Mar. 7, 2019, 30 pgs.
United States Patent and Trademark Office, Case IPR2018-00600 for U.S. Pat. No. 9,581,422 B2, Petitioner's Reply Briefing to the Precedential Opinion Panel, dated Jan. 6, 2020, 17 pgs.
United States Patent and Trademark Office, Case IPR2018-00600 for U.S. Pat. No. 9,581,422 B2, Petitioner's Reply in Inter Partes Review of U.S. Pat. No. 9,581,422, dated Mar. 7, 2019, 44 pgs.
United States Patent and Trademark Office, Final Written Decision of Case IPR2018-00600 for U.S. Pat. No. 9,581,422 B2, Paper No. 42, dated Aug. 20, 2019, 31 pgs.
United States Patent and Trademark Office, Notice of Allowance for U.S. Appl. No. 15/920,800, dated Jul. 7, 2020, 7 pgs.
United States Patent and Trademark Office, Notice of Allowance for U.S. Appl. No. 16/585,790, dated Jun. 19, 2020, 16 pgs.
United States Patent and Trademark Office, Office Action of U.S. Appl. No. 14/767,058, dated Jul. 15, 2016, 9 pgs.
United States Patent and Trademark Office, Office Action of U.S. Appl. No. 15/117,228, dated May 31, 2018, 9 pgs.

(56) References Cited

OTHER PUBLICATIONS

United States Patent and Trademark Office, Office Action of U.S. Appl. No. 15/617,344, dated Jan. 23, 2019, 5 pgs.
Thru-Tubing Systems, Series 1200—Auto Release Tool, www.thrutubingsystems.com/intervention-products-and-services.php?product=/wireline-products/series-1200-auto-release-tool, 2003, 2 pages.
INPI Argentina; Office Action for Application No. 20190101104; dated Sep. 6, 2022; 5 pages.

* cited by examiner

DETONATION ACTIVATED WIRELINE RELEASE TOOL

CROSS-REFERENCE TO RELATED APPLICATIONS

This application is a continuation of and claims priority to U.S. patent application Ser. No. 16/379,341 filed Apr. 9, 2019, which claims the benefit of U.S. Provisional Patent Application No. 62/663,629 filed Apr. 27, 2018, each of which is incorporated herein by reference in its entirety.

BACKGROUND OF THE DISCLOSURE

The wireline detonation release tool herein relates generally to the field of geological oil and gas production, more specifically to apparatus for use with wireline and e-line tools in exploration, logging, perforation operations, and more specifically to release tools used when downhole tool string becomes lodged in the well or in the casing or tubing within a wellbore. A detonation release tool is provided that enables the wireline cable to be easily released from the tool string upon activation of a detonation device housed within.

A most basic consideration in geological gas and oil exploration and production is the integrity of the well, wellbore or borehole. The stability of the wellbore becomes compromised due to mechanical stress or chemical imbalance of the surrounding rock or other geological formation. Upon perforation, the geological structure surrounding the wellbore undergoes changes in tension, compression, and shear loads as the substrate, typically rock or sand, forming the core of the hole is removed. Chemical reactions can also occur with exposure to the surrounding substrate as well as to the drilling fluid or mud used in drilling operations. Under these conditions, the rock surrounding the wellbore can become unstable, begin to deform, fracture, and impinge into the wellbore.

As equipment such as logging tools, jet cutters, plug setting equipment or perforation guns are fed through the casing or tubing in the wellbore, debris, any deformity in the tool string itself and/or in its surroundings, bending, nonlinearity in the casing or tubing, fracture, stress or other unforeseen restrictions inside the well-tubulars can cause the equipment to become lodged or stuck in the wellbore, casing or tubing. This presents one of the biggest challenges to the oil and gas production industry. With gas and petroleum production costing tens to millions of dollars at each site of exploration or production, any complication or delay caused by lodged equipment results in additional human resource time, equipment cost and high expense to operations.

When tool string equipment becomes lodged or stuck, a decision is often made to temporarily or permanently leave the tool string section in the well. An attempt can be made later to fish-out, i.e., remove, the lodged equipment or the equipment can ultimately be abandoned in the well. This decision will depend upon factors such as suspected damage, difficulty of retrieving the equipment and safety concerns. Even when tool string equipment is left in the well, it is always desirable to attempt to recover the wireline cable that is connected to the lodged equipment for reuse in further geological operations, as wireline cable often contains intricate and valuable electrical equipment that is needed and reutilized repeatedly in exploration, service and well construction.

Release tools are employed in the industry to aid in release of stuck equipment and recovery of electrical wireline cable or slickline cable. Various types of release tools are available. Standard tension heads are conventionally used on wireline equipment to attach the wireline cable to the tool-string or perforation equipment. Tension-activated heads require a portion of the pulling force of the wireline cable to be used for mechanical separation of the cable from the drilling or perforation tool. U.S. Pat. No. 9,909,376 to Hrametz et al illustrates the operation of retrieving the logging tool string after deployment. Contained in the apparatus is a spring release assembly that can reengage with the fishing neck assembly. The logging tool string is retracted using a wireline or slickline, wherein during the retracting phase, a tapered surface on the logging tool string can force open latching jaws and allow the rest of the logging tool string to move through to be retrieved. As the distal end of the tool string has passed the closing arms of the springs, the opening arms return the latching jaws to the open position, resting against the inner bore of the subassembly.

Electrically activated wireline release systems are available that release the cable from the drilling or perforation tool by electrical activation. U.S. Pat. No. 8,540,021 to McCarter et al. discloses a method and release assembly system that uses a surface controller operably associated with a downhole remote unit. One example of such system is the Releasable Wireline Cable Head (RWCH™ Tool of Halliburton Corporation, Houston, Tex., US). One advantage of electrically activated release systems over tension systems is that electrically activated wireline release systems prevent the use of the tension full-safe load of the wireline cable which can cause damage to the electrical equipment on the wireline cable.

Hydraulically activated release tools are also available. U.S. Pat. No. 8,281,851 to Spence teaches a hydraulic release tool whereby a connection between the housing carrying downhole equipment and the housing carrying the wireline cable are disconnected by a locking mechanism that is released by a slidable piston which is operated by fluid that is circulated through flow ports within the apparatus. Another cable release tool, CSR by Halliburton Corporation, uses hydraulic time-delay technology with electrical wire tension to cause mechanical release of the wireline cable from the lodged equipment. The Addressable Download Release Tool from GE Oil and Gas Company (Baker Hughes GE of Houston, Tex., US and London, UK) provides a mechanical release mechanism with three stages: an electrical feed-through commanded by a surface panel, a mechanical unlatch and hydrostatic pressure equalization and tool separation.

Detonation, explosive or ballistically activated release methods use a detonator to enable the wireline cable to disconnect from the lodged wireline tool string equipment. The ZipRelease Addressable Wireline Release Tool of GR Energy Services, LLC (Sugarland, Tex., US) is a device that uses a detonator, whereby, upon activation, a separation collar expands and actuates a shear ring to sever an equalizing plug inside the wireline release tool. The tool string is then released, allowing the wireline cable and any associated tool assemblies connected to the wireline cable to be removed from the well. The Ballistic Release Tool by Canatex Completions Solutions (Fort Worth, Tex., US), which is similar or identical to the ZipRelease tool of GR Energy Services, is specifically marketed for horizontal well operations. The Addressable Disconnect Tool by Allied Horizontal (Houston, Tex., US) uses a similar mechanism designed to be used when a perforating gun system is comprised of addressable detonator switches with only a detonator in the device which receives a specific code supplying current to fire the detonator.

Despite the range of release tools currently available, the options remain limited in their release-enabling capacity in view of the tremendous size of the worldwide gas and oil industry and the myriad of challenges presented in operations. The wireline release tool herein presents an effective and technically efficient tool for enabling controlled separation and release of the tool string from the wireline cable during operation from a lodged obstruction without damaging the remaining tools on the wireline and enabling them to continue performing their intended tasks. Unlike alternatively available release tools, the release tool herein allows direct insertion of the detonator into the release tool without need for further electrical wiring assemblies and without any additional ballistic components, thereby enabling downhole operations with minimal re-dress efforts and no explosive remnants created by other detonation activated release tools. This improves the safety of the release tool herein as compared to other ballistically activated release tools during assembly, handling and well operations.

BRIEF DESCRIPTION OF THE EXEMPLARY EMBODIMENTS

Provided is a wireline cable release tool which uses the pressure impulse from a detonator located within the release tool to effectuate upon detonation the release of the wireline cable from the wireline tool string attached thereto that is lodged in a well during oil or gas perforating operation.

BRIEF DESCRIPTION OF THE DRAWINGS

A more particular description will be rendered by reference to specific embodiments thereof that are illustrated in the appended drawings. Understanding that these drawings depict only embodiments thereof and are not therefore to be considered to be limiting of its scope, exemplary embodiments will be described and explained with additional specificity.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

Figure 1:
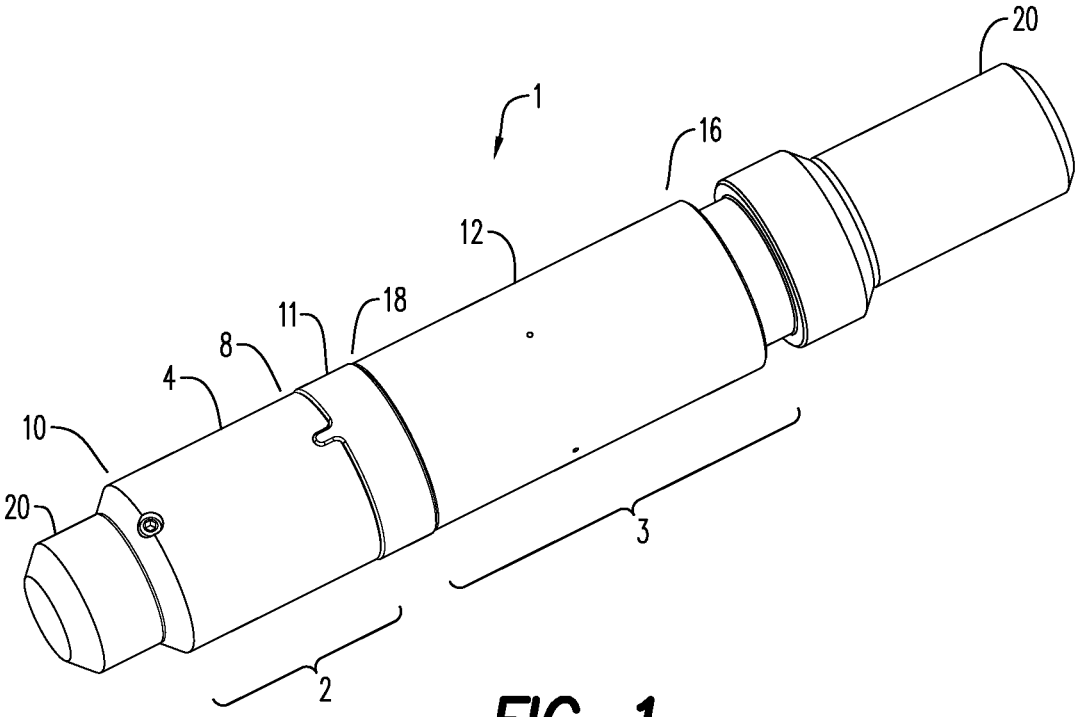

The headings used herein are for organizational purposes only and are not meant to limit the scope of the description or the claims. To facilitate understanding, reference numerals have been used, where possible, to designate like elements common to the figures.

Figure 2:
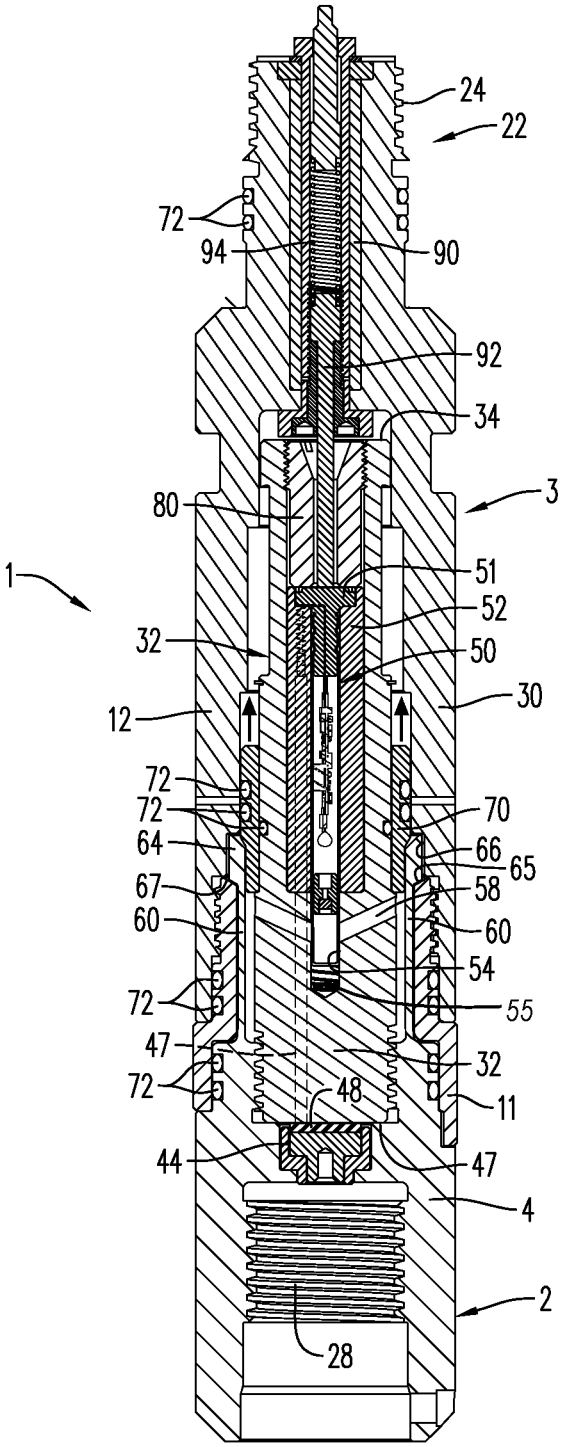
Figure 3:
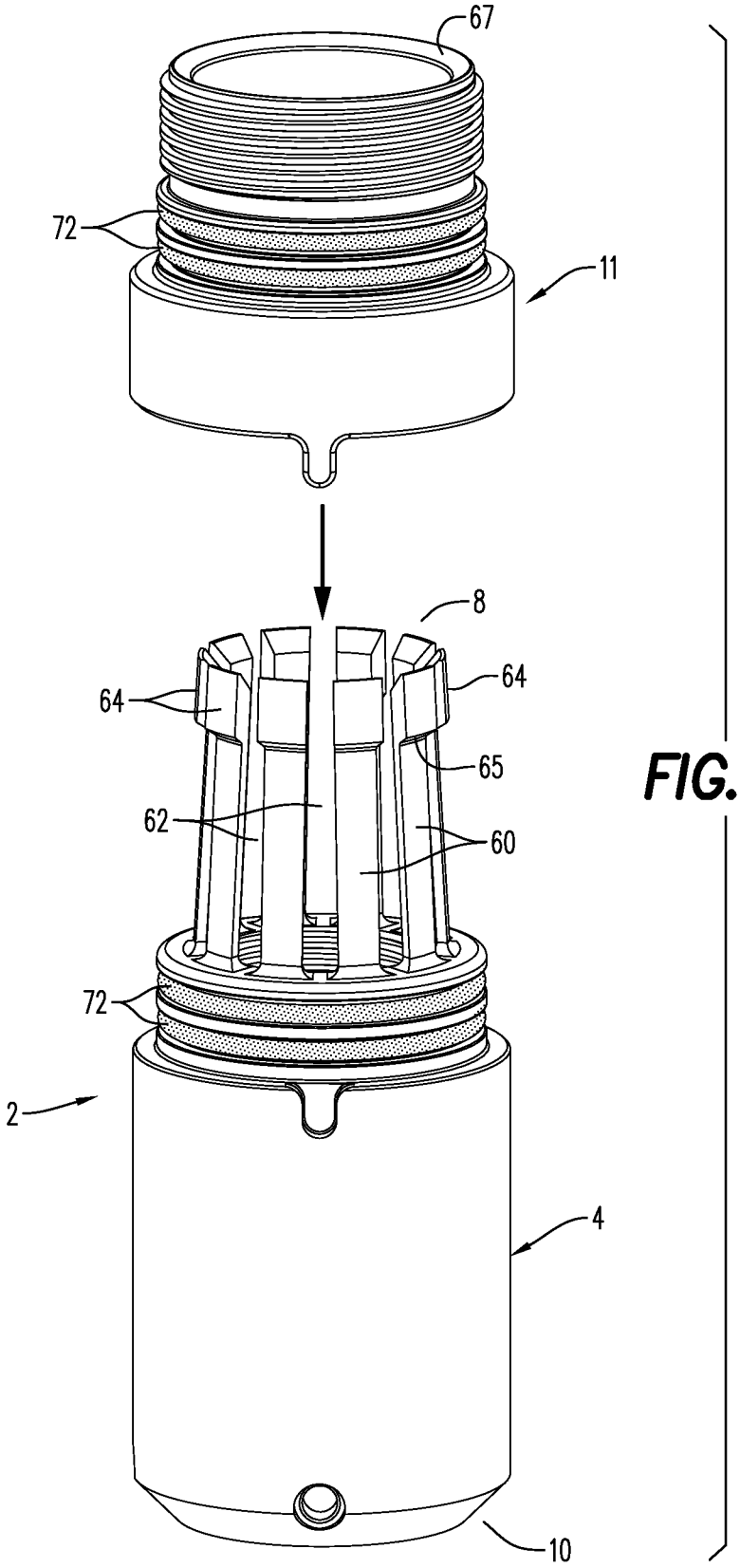
Figure 4:
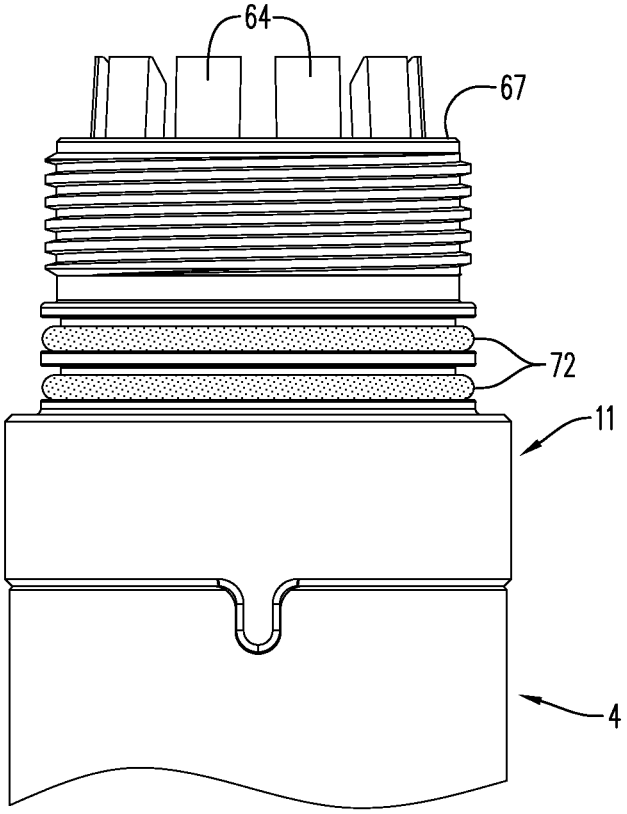
Figure 5:
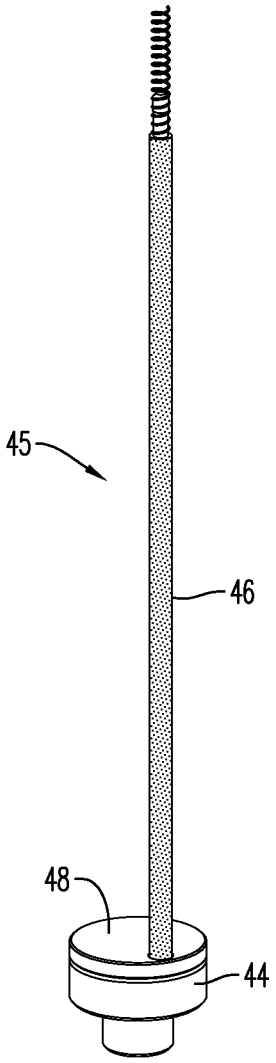
Figure 6:
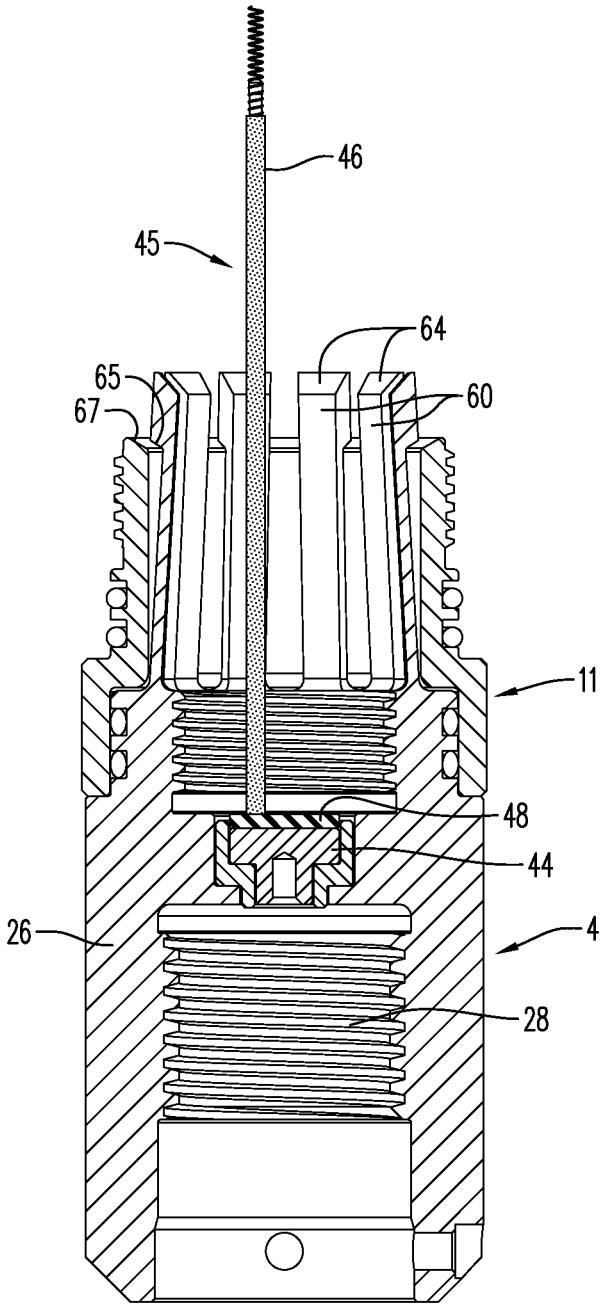
Figure 7:
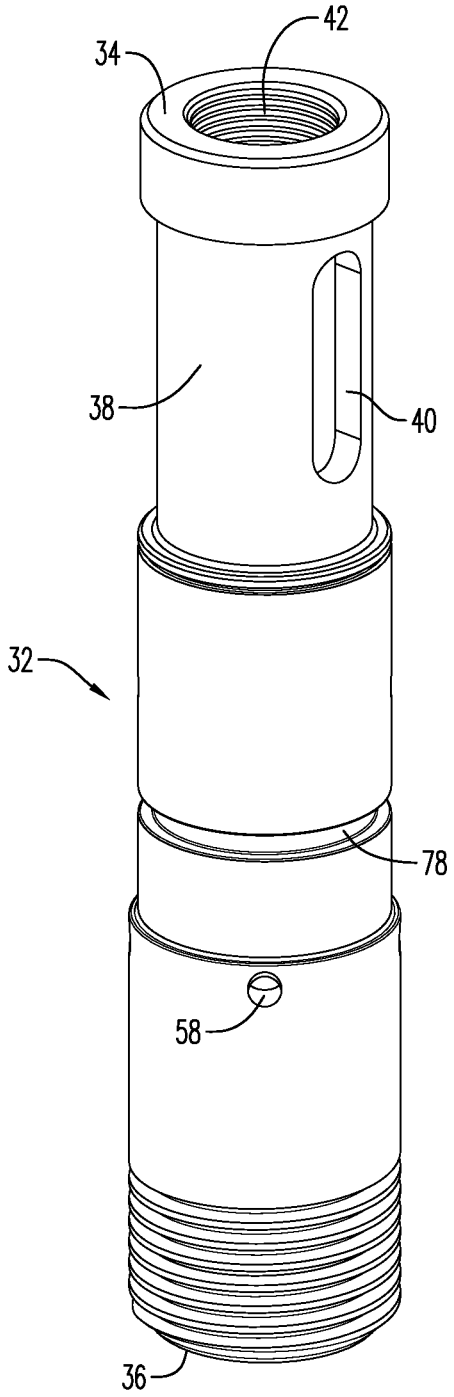
Figure 8:
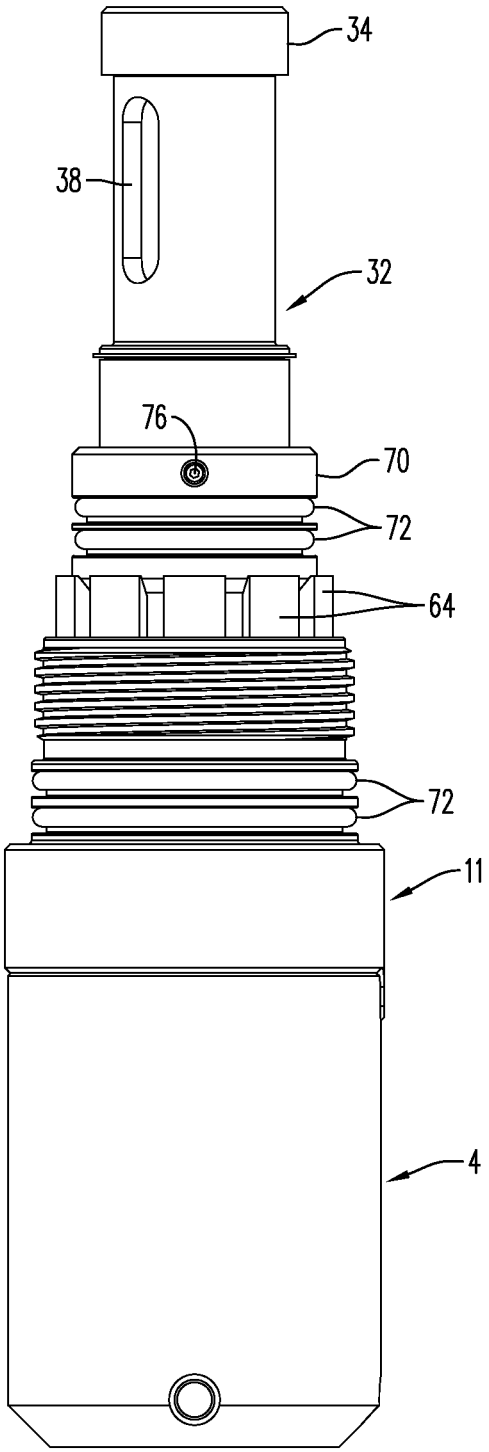
Figure 9:
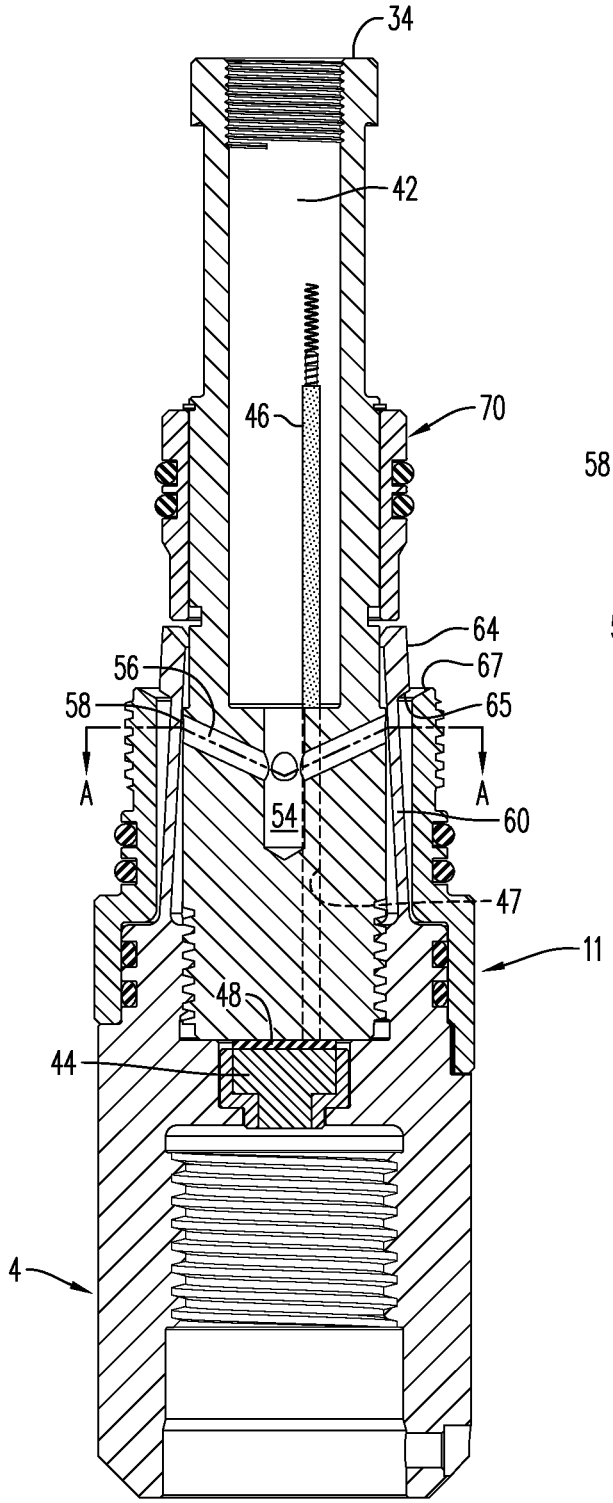
Figure 10:
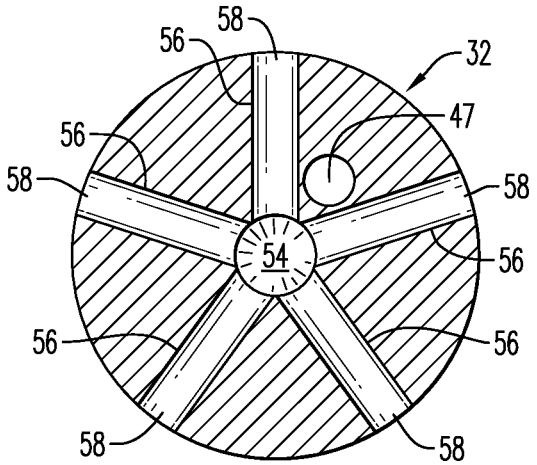
Figure 11A:
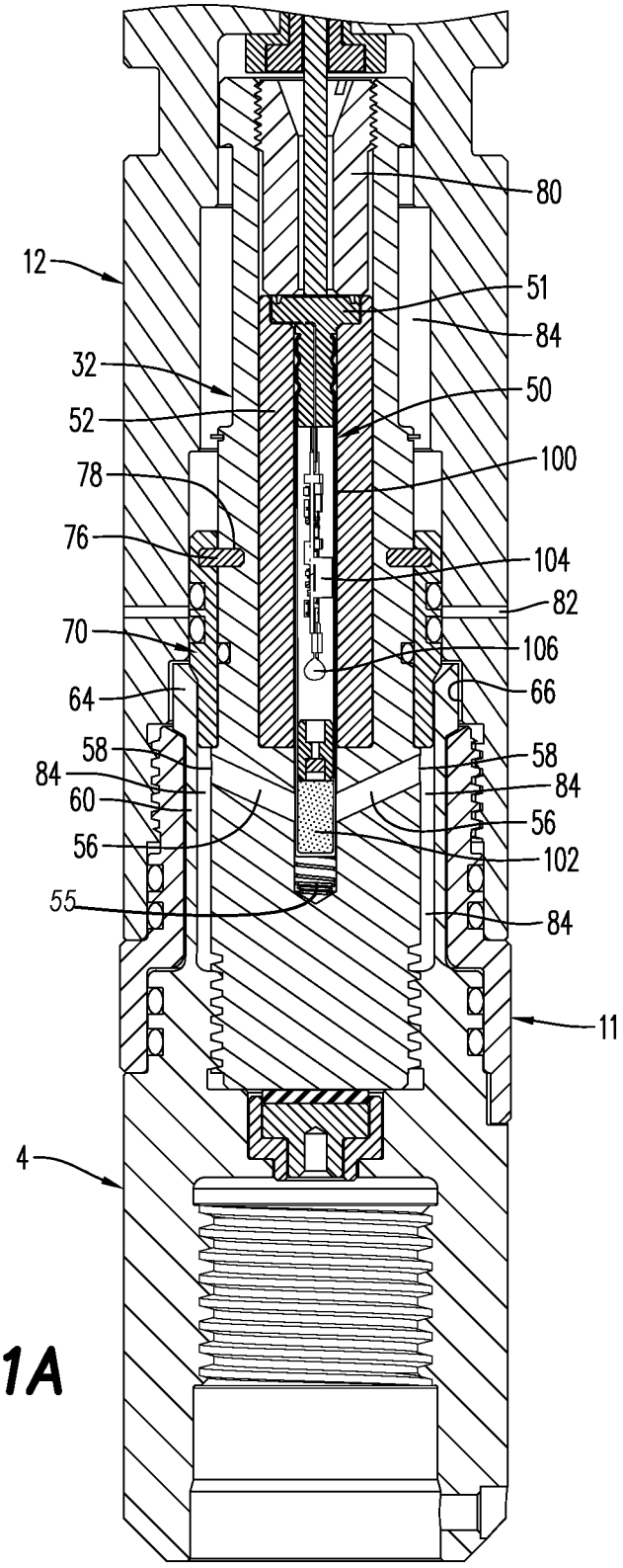
Figure 11B:
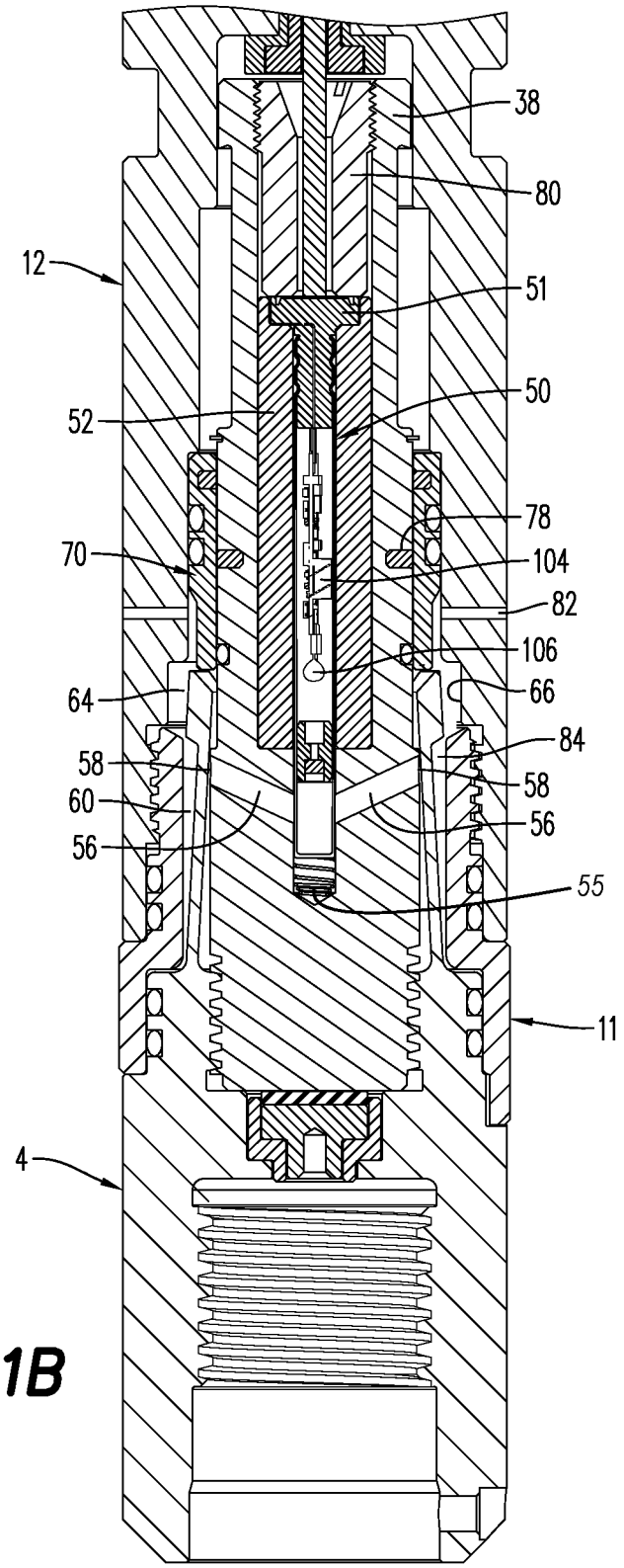
Figure 11C:
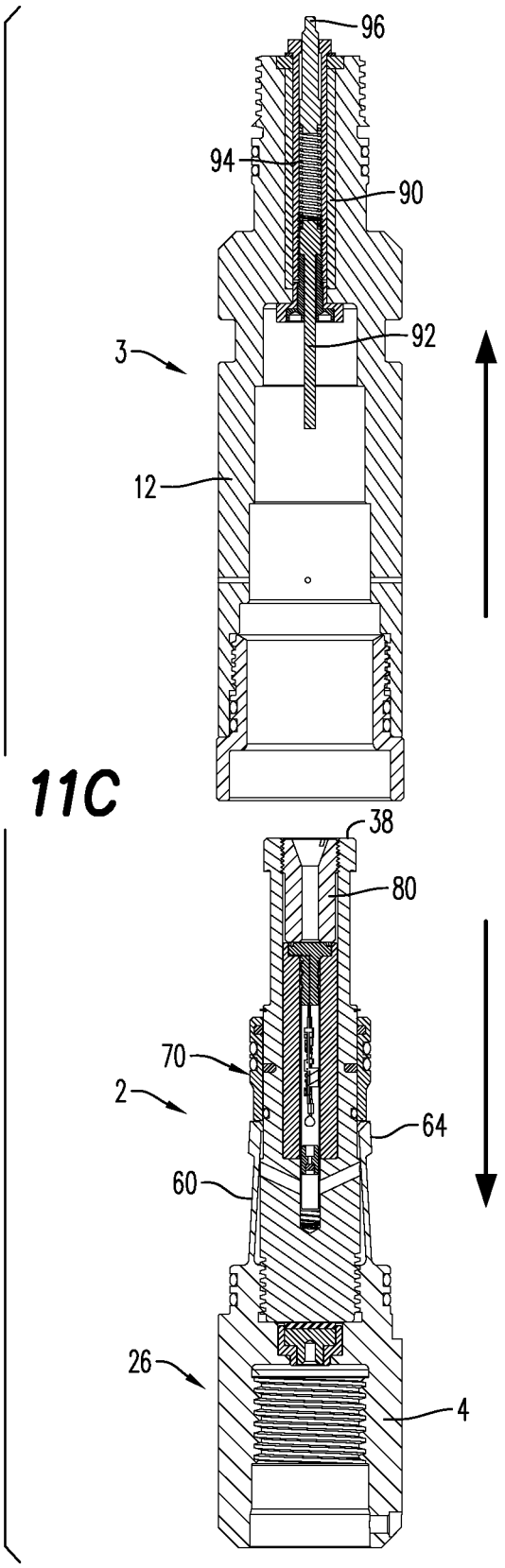
Figure 12:
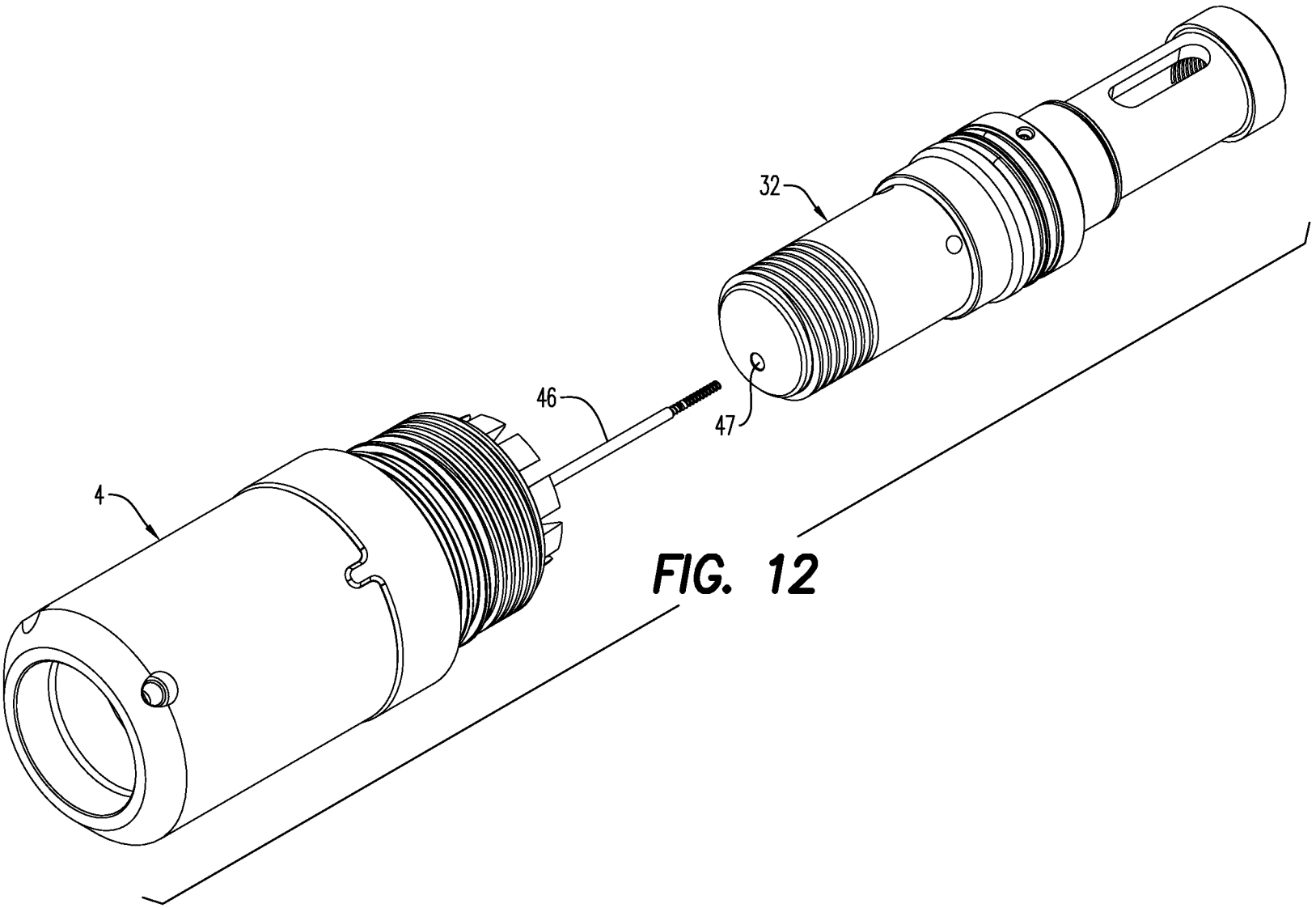
Figure 13:
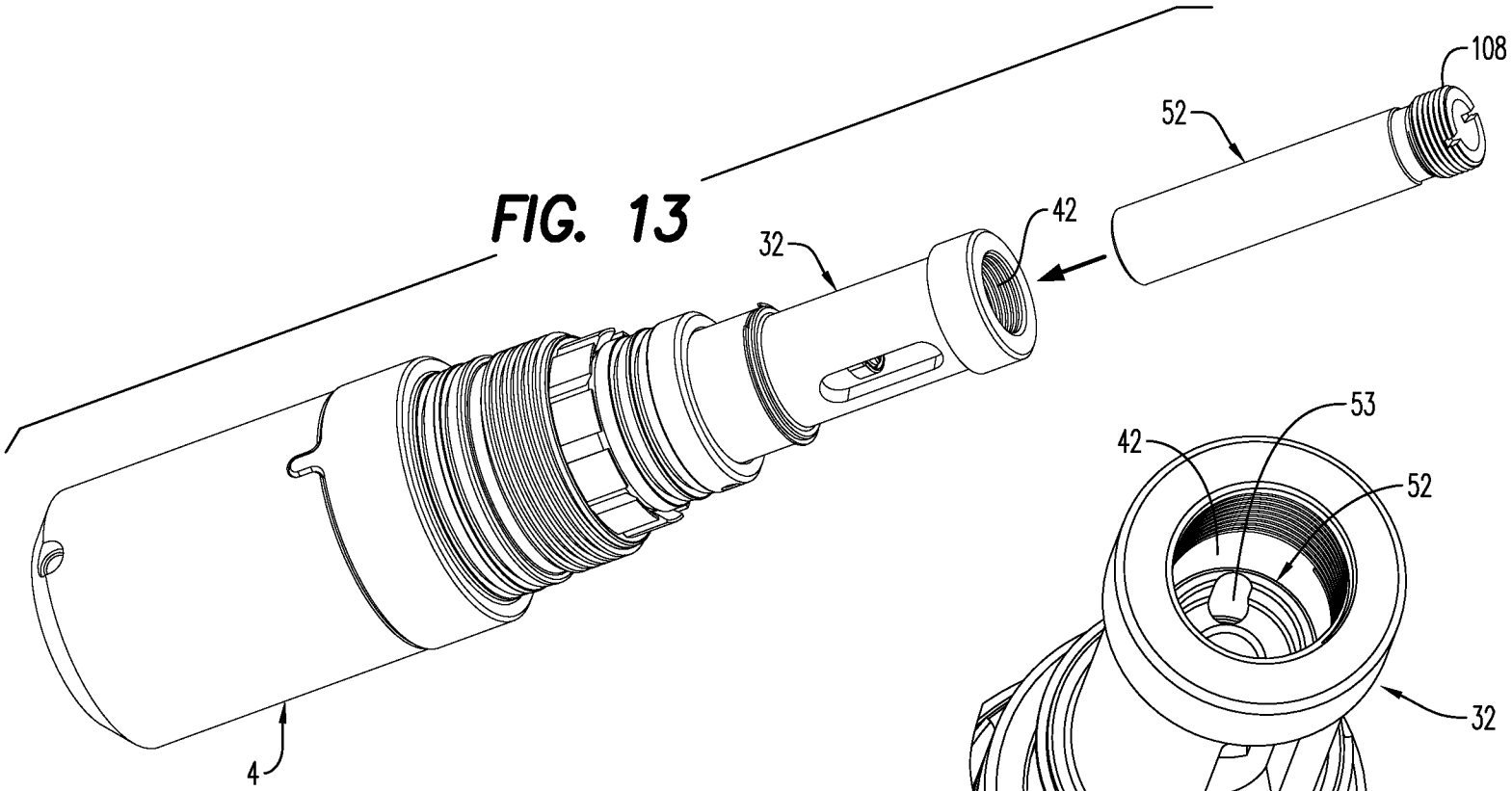
Figure 13A:
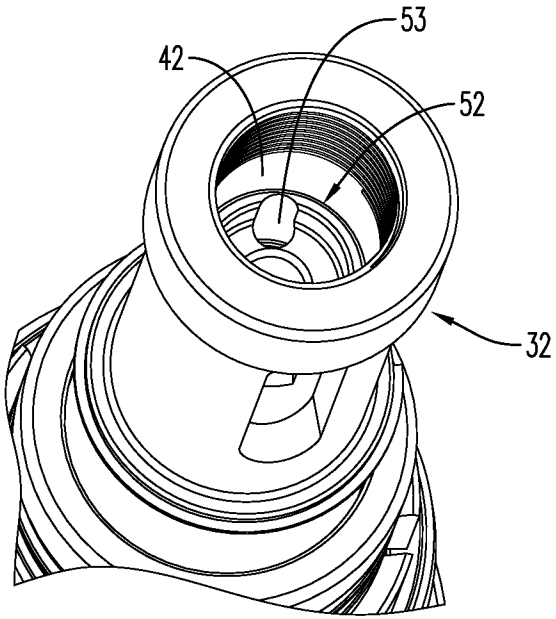
Figure 14A:
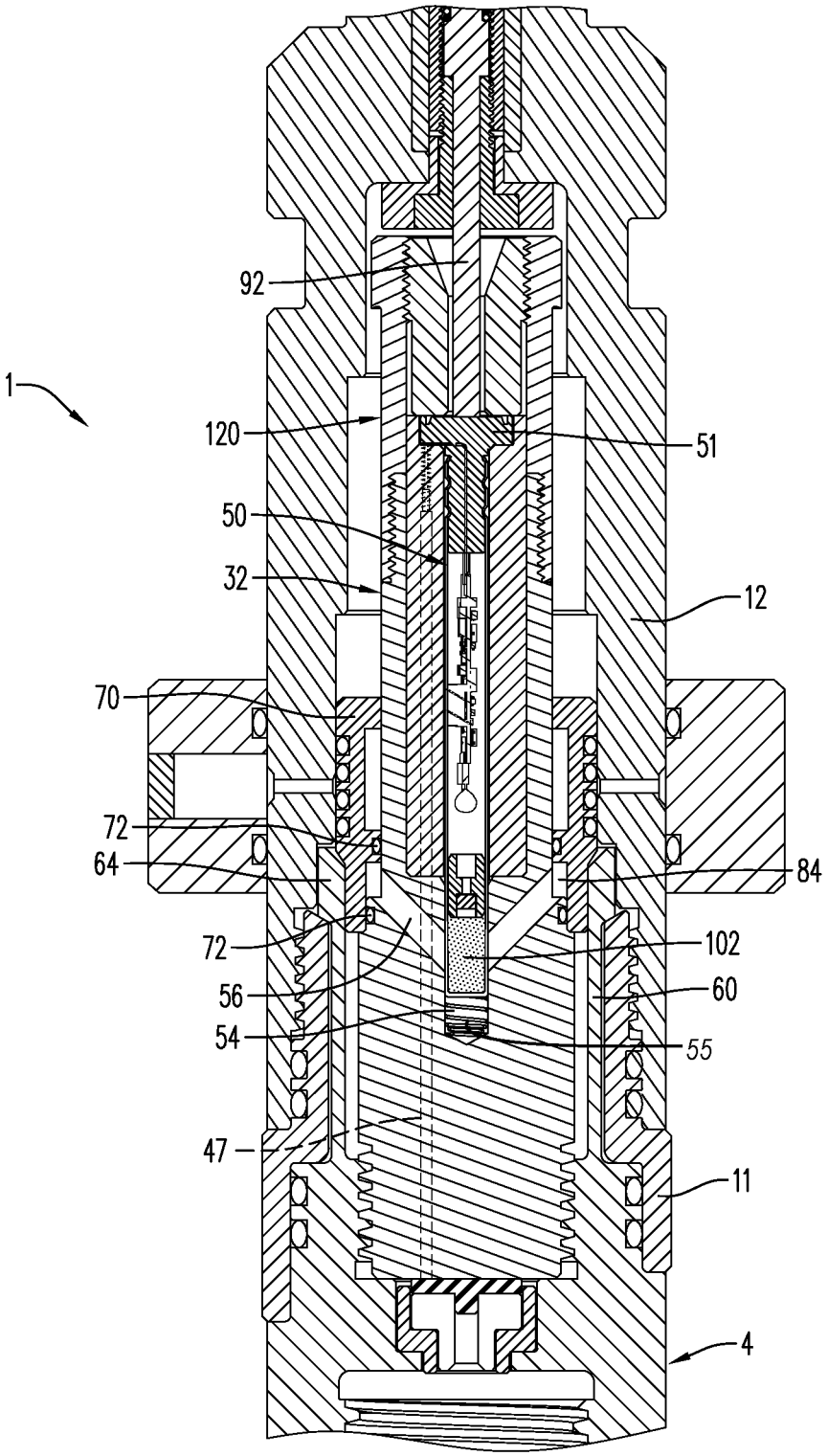
Figure 14B:
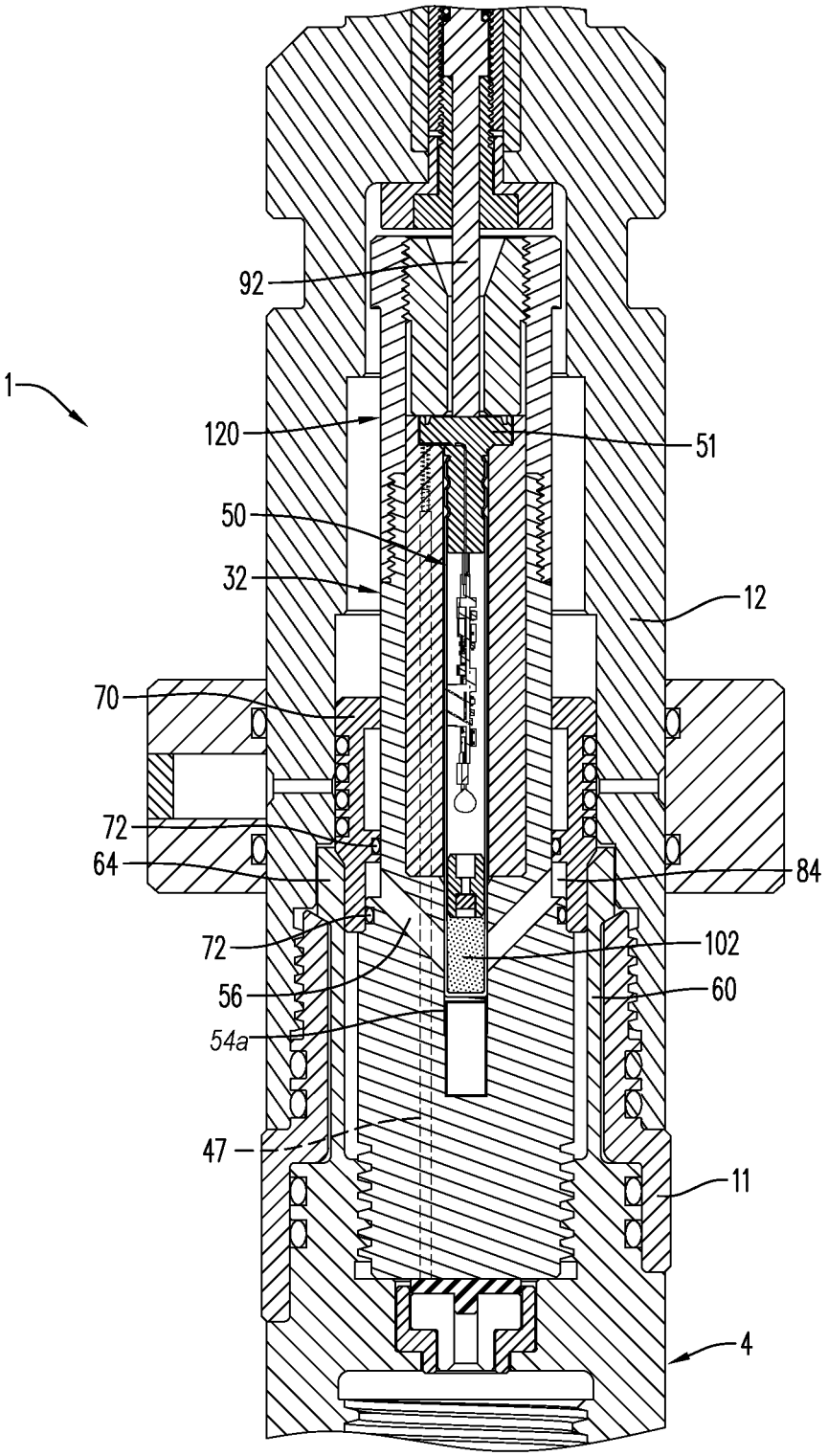
Figure 14C:
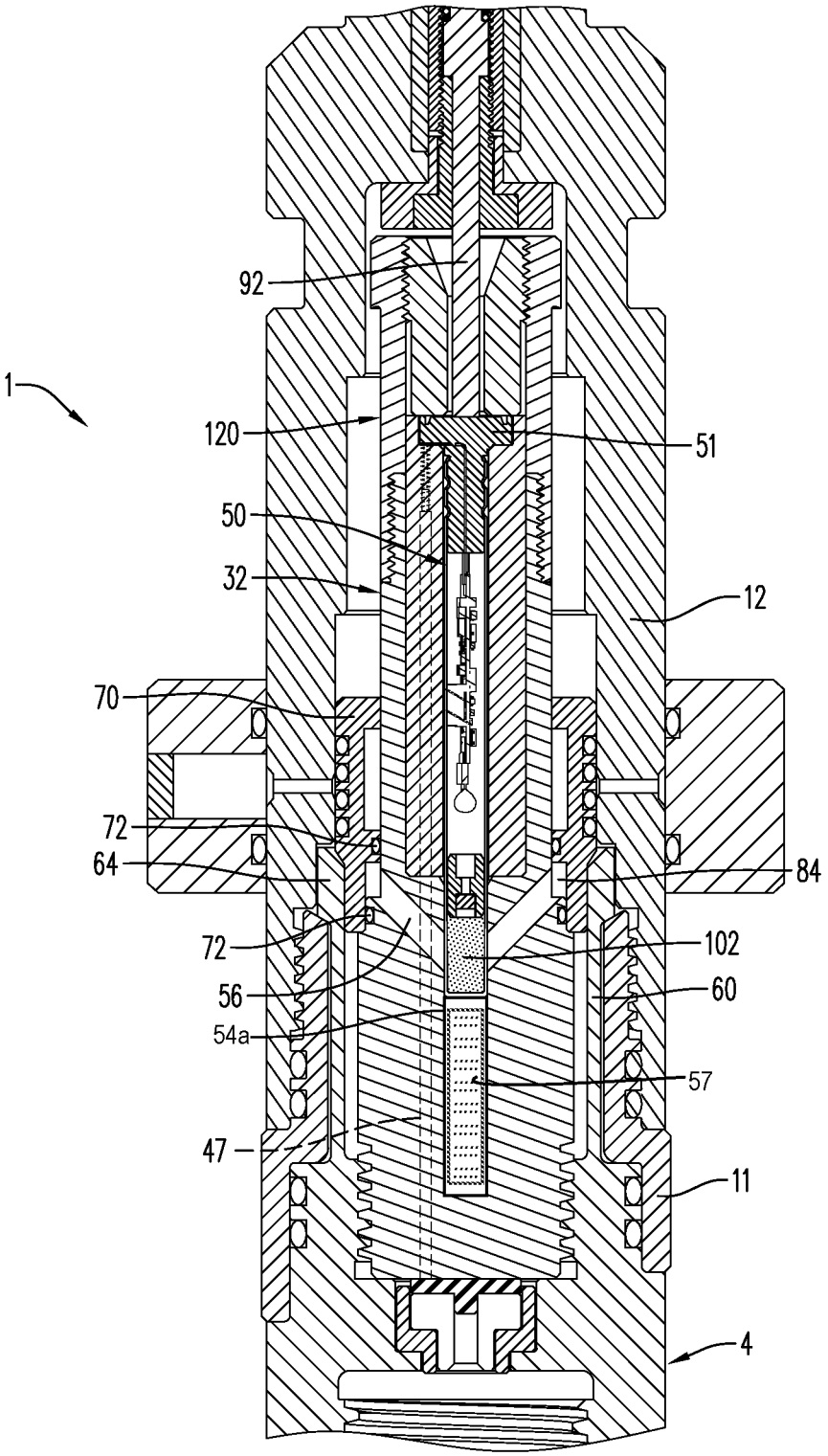

FIG. 1 is a perspective view of a ballistic release tool, according to an embodiment;

FIG. 2 is a cross-sectional view of a ballistic release tool prior to detonation, according to an embodiment;

FIG. 3 is a perspective view of an outer housing of a tool string subassembly illustrating tubing fingers and a connecting sleeve in an unassembled configuration, according to an embodiment;

FIG. 4 is a magnified perspective view of the outer housing shown in FIG. 3 showing the tubing fingers engaged circumferentially by an outer connecting sleeve;

FIG. 5 is a perspective view of an embodiment of a conductor contact subassembly operable in the release tool, according to an embodiment;

FIG. 6 is a cross-sectional view of the outer housing of the tool string subassembly shown in FIG. 4 showing the outer connecting sleeve engaged circumferentially around the tubing fingers with the conductor contact subassembly of FIG. 5;

FIG. 7 is a side elevational view a detonator housing for use with a ballistic release tool, according to an embodiment;

FIG. 8 is a side view of an outer housing of a tool string subassembly having a detonator housing therein, illustrating a detonator latch engaged around an exterior surface of the detonator housing in relation to tubing fingers, according to an embodiment;

FIG. 9 is a cut-away view along the length of FIG. 8;

FIG. 10 is a radial cross-sectional view of an alternate embodiment taken along lines A-A of FIG. 9 showing a radial arrangement of radial vents around a central vent;

FIG. 11A is a partial, cross-sectional view of a ballistic release tool, illustrating a plurality of tubing fingers of a tool string assembly, according to an embodiment;

FIG. 11B is a partial, cross-sectional view of the ballistic release tool of FIG. 11A, illustrating the fingers in their relaxed/collapsed position and disengaged from the detonational latch;

FIG. 11C is a partial cross-sectional view of a ballistic release tool, illustrating a tool string subassembly being released/disengaged from a wireline subassembly, according to an embodiment; and FIG. 12 is a partial exploded view of the ballistic release tool of FIG. 11B, illustrating a detonator housing being released/disengaged from a outer housing, according to an embodiment;

FIG. 13 is a perspective view of a ballistic release tool, illustrating a detonator sleeve being inserted into a central bore of a detonator housing, according to an embodiment;

FIG. 13A is a side elevation view of the ballistic release tool of FIG. 13, illustrating a detonator head receiving portion of the detonator sleeve;

FIG. 14A is side, cross-sectional view of a ballistic release tool including an expansion chamber, according to an embodiment;

FIG. 14B is side, cross-sectional view of the ballistic release tool of FIG. 14A including an elongated central vent; and FIG. 14C is side, cross-sectional view of the ballistic release tool of FIG. 14A including a booster charge.

DETAILED DESCRIPTION

Reference is made in detail to various embodiments. Each example is provided by way of explanation, and is not meant as a limitation and does not constitute a definition of all possible embodiments. For purposes of illustrating features of the embodiments, examples are referenced throughout the disclosure. Those skilled in the art will recognize that the examples are illustrative and not limiting and are provided for explanatory purposes.

As used herein, the term "downhole" refers to the direction going into the well during a well operation. Conversely, the term "uphole" refers to the direction going upward toward the earth's surface. Consistent therewith, the term "downward" is used herein to indicate the direction of the release tool herein that is directed in the downhole direction; and the term "upward" is used herein to indicate an uphole direction in the well.

As used herein, the term "wireline" is used interchangeably and intended to incorporate the term wireline cable. In typical well operations, wireline cable conveys equipment such as logging equipment for collecting data like temperature and pressure and for measuring other well parameters; cameras for optical observation; equipment for performing radioactive irradiation; logging equipment for performing evaluation of localized geological strata; electrical equipment for conveying electrical signals and information from the surface to the downhole tool string to which the wireline is connected; and other tools used in well operations. As used herein, wireline also includes electric line, e-line or slickline, whereby a single strand is used in a well operation. In alternate embodiments, coiled tubing with an electrical feedthrough, commonly known as E-coil, as well as a coiled tubing without an electrical conductor, are operable with the release tool herein. According to other embodiments, it will be further understood by persons skilled in the art that other cables that are used to introduce and deliver tools downhole are operable with the release tool herein.

As used herein, the term "tool string" refers to equipment such as logging equipment, perforation guns, jet cutters, fracturing tools, acidizing tools, cementing tools, production enhancement tools, completion tools or any other tool capable of being coupled to a downhole string for performing a downhole well operation.

As used herein, the term "detonator" is used interchangeably with the term "detonation device" and will be more fully described herein.

Turning now to the figures, FIG. 1 illustrates a release tool in accordance with an embodiment. The release tool 1 comprises a tool string subassembly 2 connected to a wireline subassembly 3. The tool string subassembly 2 comprises an outer housing 4 enclosing an inner chamber and having an upper portion terminating at upper end 8 and a lower portion terminating at lower end 10. The wireline subassembly 3 comprises an outer housing 12 enclosing an inner chamber and having an upper portion terminating at an upper end 16 and a lower portion terminating at a lower end 18. As would be understood by one of ordinary skill in the art, end caps may be included on the release tool herein, and may be formed of steel, aluminum, thermoplastic or other resistant material. FIG. 1 illustrates the end caps 20 optionally mounted at the lower ends 10 and 18, respectively of the tool subassemblies. The wireline tool string subassembly 2 and wireline subassembly 3 may be coupled together by a threaded connection.

As seen in FIG. 1, outer housing 4 may be of the same diameter as outer housing 12, together forming a single cylindrical body or tubing. The outer housings 4 and 12 may be manufactured from materials used in the manufacture of release tools necessitating materials able to withstand massive pressure and force, such as heat-treated steel. The release tool is conveyed into the well using a fluid delivery system that propels tool strings deployed into a wellbore, as will be understood by those skilled in the art.

Referring to FIG. 2, the wireline subassembly 3 includes an industry standard wireline cable head engagement subassembly 22 that is positioned within the inner chamber of the wireline subassembly 3. The wireline cable head engagement subassembly 22 is operable to couple the release tool 1 to a distal downhole wireline cable (not shown). The wireline cable head engagement subassembly 22 may include a mating portion 24, such as grooves, threaded connection or other configuration operable to receive and retain a receiving portion (not shown) formed on the wireline cable (not shown).

The tool string subassembly 2 is configured to connect by, for example, a threaded connection, to a downhole tool or tool string by an industry standard tool string engagement subassembly 26 housed downhole within the outer housing 4 of the tool string subassembly 2. The tool string engagement subassembly 26 includes a threaded receiving portion 28 operable in connecting to a mating portion (not shown) of a tool string or downhole tool. During well operation, the release tool 1 is connected to the tool string at the tool string engagement subassembly 26 and connected to the wireline cable by the wireline cable engagement subassembly 22 and is deployed into the well.

As tool string is run into a well to perform a downhole operation, shock and pressure created during the operation is absorbed by the outer housing 4 of the tool string subassembly 2 and the outer housing 12 of the wireline subassembly 3. Tool string outer housing 4 and wireline outer housing 12 may be connected to one another by a connecting means such as a connecting sleeve 11. According to an aspect, the connecting means may include threaded connections or any other coupling mechanism. As described below, connecting sleeve 11 may be designed to be rigidly connected, e.g., through threads, to one of the tool string outer housing 4 or the wireline outer housing 12 and releasably connected to the other of the tool string outer housing 4 or the wireline outer housing 12. Under such circumstances, release of the releasable connection results in disconnection of the wireline subassembly 3 from the tool string subassembly 2. More specific details of possible arrangements to achieve this function are presented hereinbelow.

In an embodiment of the release tool 1, release by the connecting sleeve 11 may be deliberately caused by an explosive force from a detonator 50. It is contemplated that the detonator 50 may be a wired detonator or a wireless detonator. Thus, separation of the wireline subassembly 3 from the tool string subassembly 2 may be achieved by activating the detonator 50. A detonator housing/energetic device housing 32 is contained in the inner chamber of the downhole tool string subassembly 2 and extends upward into the inner chamber of the wireline subassembly 3. The detonator housing 32 is illustrated in FIG. 7. It has an upper end 34 and a lower end 36. The detonator housing 32 includes a fishing neck 38 operable to engage with wireline fishing and retrieval equipment, as known to persons skilled in the art.

According to an embodiment, the detonator housing 32 is manufactured from injection molded plastic. It is contemplated that any other structurally sound and insulating material may be used to form the detonator housing 32, as would be known to persons skilled in the art. The detonator housing 32 includes a cylindrical center bore 42, shown in FIG. 7. The aperture 40 in the detonator housing 32 simplifies removal of the detonator 50 during assembly and re-dress.

As illustrated in FIG. 2, the center bore 42 of the detonator housing is primarily occupied by a detonator 50 contained in a detonator sleeve 52. Since the detonator 50 is configured to be inserted into the detonator sleeve 52 with ease to a user, a bushing 80 may be screwed in or otherwise connected to the upper end of the center bore 42 to maintain the position of the detonator 50 in the detonator housing 32. The bushing 80 may help maintain the stability of the detonator 50 during downhole well operations, ensuring that it can be reliably electrically contacted. According to an aspect, the bushing 80 is composed of an insulating or insulative material. The bushing 80 may be composed of any high-performance thermoplastic with a temperature rating above 200° C., certain embodiments being polyetheretherketone (PEEK), polyoxymethylene (POM), polytetrafluoroethylene (PTFE) and polyamide. According to another embodiment, the bushing 80 is composed of anodized aluminum. Before activation and detonation of the explosive load of the detonator, the bushing 80 functions to prevent or minimize the movement of the detonator 50 within the center bore 42 in the detonator housing 32, which is caused by the force of explosion emitting useful energy during detonation.

The detonator 50 includes a detonator head 51, a detonator shell 100, an electrical circuit board 104 and an explosive load 102. The detonator head 51 has electrical contacts for contacting a line-in and may also have an electrical contact for contacting a line-out. According to an aspect, a grounding spring 55 may be adjacent the detonator shell 100. The line-in electrical contact and the circuit board 104 are parts of a means for receiving a selective ignition signal. After receipt of the selective ignition signal, circuit board 104 sends an electrical signal to a fuse head 106 immediately adjacent the explosive load 102. According to an embodiment, the fuse head 106 may be any device capable of converting an electric signal into an explosion. The ignition of the fuse head 106 by the electrical signal from the circuit board 104 results in detonation of the explosive load 102. For a given explosive chosen for the explosive load 102, the energy released by the explosive load 102 will correlate to the volume of the explosive load 102.

It is typically necessary to electrically connect the wireline to the tool string since the tool string will also contain electrical components which need to be communicated with during the well operation. FIG. 5 and FIG. 6 illustrate a conductor contact subassembly 45 for conducting electrical signal to the tool string. The conductor contact subassembly 45 has a conductor rod 46 attached to a terminal contact 44. To the extent that the conductor rod 46 needs to pass through any structural element of the release tool 1 in order to connect to the wireline and terminal contact 44, a channel may be provided through that element. For example, FIG. 12 illustrates a channel 47 for the conductor rod 46 formed in the detonator housing 32. The channel 47 allows the conductor rod 46 to extend through the base of the detonator housing 32 and into the center bore 42 of the detonator housing 32, as shown FIG. 10.

Detonator sleeve 52 may also have a channel 53 for the conductor rod 46. FIG. 13 shows detonator sleeve 52 being inserted into central bore 42 of detonator housing 32. As with detonator housing channel 47, channel 53 of detonator sleeve 52 must be aligned with conductor rod 46 in order to insert the detonator sleeve 52 into the detonator housing 52. FIG. 13A illustrates the top end of conductor rod 46 adjacent the top end of channel 53 subsequent to proper insertion of the detonator sleeve 52 into the detonator housing 52. FIG. 13A also illustrates the detonator head receiving portion 108 of detonator sleeve 52, i.e., detonator head 52 will occupy detonator head receiving portion 108 after insertion of detonator 50 into detonator sleeve 52. Electrically connecting the wireline to release tool 1 results in the conductor contact subassembly 45 being electrically contacted adjacent the head 51 of detonator 50 and, thus, an electrical connection from the wireline to the tool string through the release tool 1.

In an embodiment, conductor rod 46 extends from channel 53 in detonator sleeve 52 and electrically connects to a line-out electrical connection on or adjacent the head 51 of the detonator 50. The other end of conductor rod is attached to terminal contact 44. Terminal contact 44 is axially centered and shaped such that it may freely rotate while maintaining electrical contact with the tool string. The ability of terminal contact 44 to maintain electrical contact while rotating about the central axis of the release tool 1 results in conductor rod 46 being able to travel in a circle centered on the release tool 1 axis. This rotational freedom allows parts through which conductor rod 46 is disposed, e.g., detonator housing 44 and detonator sleeve 52, to freely rotate. Such free rotation enables, for example, assembly and disassembly of release tool 1 with threaded connections. A terminal insulator disc 48 may be provided on the upper side of the terminal contact 44 as shown in FIG. 5.

The detonator 50 according to the release tool 1 herein receives a signal and is initiated, such that it generates an explosive force. As illustrated in at least FIGS. 2, 11A-11C, 13 and 14A-14C, the detonator 50 may be a wirelessly-connectable selective detonation device, such as the wireless detonator disclosed in commonly-owned and assigned U.S. Pat. Nos. 9,581,422 and 9,605,937 to Preiss et al., incorporated herein by reference in their entireties to the extent that they are consistent with this disclosure. The detonators include a main explosive load, such as explosive load 102, that generates the explosive force.

The wireless detonator 50 utilized with the release tool 1 is configured to be electrically contactably received within the detonator housing 32 without using wired electrical connections, such as leg-wires. The wireless detonator 50 forms an electrical connection by inserting the detonator 50 into the detonator sleeve 52, i.e., without the need for manually and physically connecting, cutting or crimping wires as required in a wired electrical connection. Referring to FIG. 2 and FIG. 13A, and as discussed previously herein, an electrically conducting line-out portion on or adjacent the underside of detonator head 51 is configured to electrically contact the conductor rod 46 when detonator 50 is inserted into detonator sleeve 52 and detonator head 51 occupies detonator head receiving portion 108.

Wireline subassembly 3 includes a wireline electrical contact subassembly 90 having a detonator contact pin 92, a pin spring 94 and a wireline contact pin 96. The pin spring 94 is electrically conducting and electrically contacts both the detonator contact pin 92 and the wireline contact pin 96. As illustrated in FIG. 11C, attachment of wireline subassembly 3 to tool string subassembly 2 results in detonator contact pin 92 coming into electrical contact with detonator head 51 and, thus, conveying a line-in electrical signal to the detonator 50. Detonator contact pin 92 may be spring loaded via pin spring 94 such that detonator contact pin 92 will contact detonator head 51 across a fairly broad axial range without exerting excessive force. Wireline contact pin 96 may also be spring loaded. Any conventional means of establishing electrical contact between the wireline and the wireline contact pin 96 may be used when attaching the release tool 1 to the wireline.

According to an aspect, and distinguished from alternative detonation activated release tools, the release tool 1 does not require any flammable solids and/or other pressure generating media other than those contained in the detonator shell 100 of the detonator 50. That is, the release tool 1 herein described results in release of the tool string and/or wireline cable by operation of the detonator 50 alone.

Turning now to FIG. 3, the cylindrical outer housing 4 of tool string subassembly 2 extends upward, and may be at least partially tapered. A plurality of tubing fingers 60 extend from the outer housing 4. According to an aspect, a space, groove or channel 62 is between each tubing finger 60. Each tubing finger 60 continues to form into a tip, protrusion or flange 64 at the upper end 8 of the outer housing 4. The space 62 between tubing fingers 60 allows each finger to deflect radially inward and outward when subjected to a radial force, particularly to a radial force exerted on the flange 64 thereof. When fingers 60 are subjected to an outward radial force, flanges 64 are adapted to be received within one or a plurality of compatible receiving grooves or recesses 66 in the inner wall at the lower end 18 of the outer housing 12 of the wireline subassembly 3. The flanges 64 and receiving groove 66 permit a tightening engagement between the tool string subassembly and the wireline subassembly.

According to an aspect, a latch 70 is circumferentially mounted on the external surface of the detonator housing 32. The latch 70 may be substantially cylindrical. According to an embodiment, one or a plurality of shear pins 76 extend through the annular wall of latch 70 and engage pin channels 78 in detonator housing 32 and function to prevent unintentional movement of the latch 70 relative to the detonator housing 32. More to the point, shear pins 76 prevent latch 70 from shifting axially along the outer surface of detonator housing 32. Thus, once latch 70 is properly placed on detonator housing 32, shear pins 76 will hold latch 70 in place relative to the detonator housing 32.

As illustrated in FIG. 8, the latch 70 is mounted onto the external surface of the detonator housing 32 and detonator housing 32 is inserted into the inner chamber of the tool string subassembly 2. In an embodiment, detonator housing 32 is threadably connected to the tool string subassembly 2. As detonator housing 32 is threaded into connection with tool string subassembly 2, the outer surface of latch 70 slides under the flanges 64 of fingers 60 and exerts a radially outward force on the flanges 64 of the tubing fingers 60. When detonator housing 32 is fully threaded into the tool string subassembly 2, the latch 70 is thereby lodged under the flanges 64 and causes flanges 64 to be disposed in receiving grooves or recesses 66, as illustrated in FIG. 2.

Of critical importance to the function of latch 70, each flange 64 has an underside 65. Without any radial forces being exerted on fingers 60, flanges 64 do not interfere or interfere minimally with the connecting sleeve 11 such that the assembly step shown in FIG. 3 is easily accomplished. When attachment of detonator housing 32 to the tool string subassembly 2 is complete, latch 70 is lodged under the flanges 64 and causes the undersides 65 of flanges 64 to each engage a top surface 67 of the connecting sleeve 11. The location and form of flange underside 65 and top surface 67 of connecting sleeve 11 is well illustrated in FIG. 6 as well as in FIG. 9. Since the fingers 66 are integral parts of the tool string subassembly 2, engagement of the flange 64 undersides 65 with the top surface 67 of connecting sleeve 11 will prevent connecting sleeve 11 and any structural element connected to connecting sleeve 11 from disengaging from the tool string subassembly 2. Removal of the outward radial forces on fingers 60 by latch 70 will result in flange 64 undersides 65 disengaging from the top surface 67 of the connecting sleeve 11. A reasonable axial force tending to pull tool string subassembly 2 and wireline subassembly 3 away from one another at a time when the undersides 65 of flanges 64 are not engaged with the top surface 67 of connecting sleeve 11 will result in disconnection of the tool string subassembly 2 and wireline subassembly 3. In the embodiment shown in FIG. 2, outer housing 12 of wireline subassembly 3 is rigidly connected to connecting sleeve 11 by a threaded connection. Thus, disengagement of the flanges 64 from connecting sleeve 11 results in wireline subassembly 3 and connecting sleeve 11 disengaging from tool string subassembly 2, as illustrated in FIG. 11C.

In light of the foregoing, the primary function of release tool 1, i.e., deliberate disconnection between wireline subassembly 3 and tool string subassembly 2, may be accomplished by eliminating the outward radial forces on fingers 60 by latch 70. In the event that shear pins 76 do not restrain latch 70, axial movement of latch 70 in the upward direction shown in FIG. 2 is possible. Such movement by latch 70 will result in latch 70 no longer exerting an outward radial force on fingers 66 and flanges 64 eventually disengaging from connecting sleeve 11. Since shear pins 76 are designed to fail, i.e., shear, upon latch 70 being subjected to an sufficient axial force, axial movement of latch 70 becomes an issue of exerting a sufficient axial force on latch 70 to result in failure of shear pins 76. In an embodiment, this axial force is achieved with the detonator 50 and a set of vents, the operation of which is described hereinbelow.

FIG. 9 illustrates the set of vents used to convey energy from the detonator 50 to the latch 70. A central vent 54 in the lower portion of the detonator housing 32 extends downward from the center bore 42. The central vent 54 may include the ground spring 55. One or more radial vent(s) 56 extend radially from the central vent 54 to the exterior of detonator housing 32. FIG. 9 shows two radial vents 56 in a lateral cross section view of the detonator subassembly 30. According to other embodiments, a plurality of radial vents 56 may be provided, such as three, four or five radial vents 56. FIG. 10 is a cross-sectional view showing central vent 54 surrounded by five radial vents 56 extending from central vent 54 through the detonator housing 32. Each of the radial vents 56 exits the detonator housing 32 at vent port 58 into an expansion chamber 84 bounded by the external surface of the detonator housing, the internal surface of the connecting sleeve 11 and/or the internal surface of the outer housing 12 of the wireline subassembly 3.

Associated with the functioning of the expansion chamber 84, one or a plurality of o-rings 72 may be disposed circumferentially in grooves or recesses 74 around the external surface of the connecting sleeve 11 and the latch 70. The o-rings around the connecting sleeve 11 function to provide a tight seal between the outer housing 12 of the wireline subassembly 3 and the outer housing 4 of the tool string subassembly 2. The o-rings around the detonator latch 70 function to seal the expansion chamber 84 of the release tool 1. Collectively, the o-ring(s) in the vicinity of the latch 70 and expansion chamber 84 serve to prevent any fluid from entering the expansion chamber 84 during use of the release tool 1 as well as to assure as great a proportion as possible of the detonation force from detonator 50 remains in the expansion chamber 84.

Upon detonation of detonator 50, rapidly expanding gases fill the radial vents 56 and the expansion chamber 84. Proper sealing of expansion chamber 84, e.g., by various o-rings, results in the expanding gases building pressure within the expansion chamber 84. This pressure builds as the energetic material in detonator 50 continues to burn, exerting an increasing axial force on the latch 70 toward the wireline end of the release tool 1. The amount of energetic material, e.g., volume of explosive load 102, is selected such that the axial force exerted on latch 70 exceeds the force necessary to shear all shear pins 76. Once shear pins 76 are sheared, latch 70 is able to move axially toward the wireline end of the release tool 1. This axial movement of latch 70 will result in latch 70 no longer exerting an outward radial force on fingers 66 and flanges 64 eventually disengaging from connecting sleeve 11. As noted above, this chain of events results in tool string subassembly 2 disconnecting from wireline subassembly 3. Once the tool string has been released, the wireline subassembly 3 and the attached wireline may be safely retrieved from the wellbore.

One or more pressure channels 82 extend through the body of the outer housing 12 of wireline subassembly 3 from the inner chamber to the exterior of outer housing 12. The pressure channels 82 may allow well pressure from the wellbore to enter the release tool 1. According to an aspect, the pressure channels 82 faciliate up to about 20,000 psi of well pressure to enter the release tool 1. When the latch 70 is engaged in the latched position (FIG. 11A), the well pressure is isolated from the expansion chamber 84 in the inner chamber of the release tool 1 by the tight engagement of the o-rings 72 on either side of the pressure channels 82. More importantly, continued axial movement of latch 70 after disengagement of flanges 64 from connecting sleeve 11 eventually results in a path being opened between expansion chamber 84 and the pressure channels 82. Since the required function of the explosive load 102 has already been accomplished, the excess energy therefrom is vented out of expansion chamber 84 through pressure channels 82. This venting prevents damage to the release tool 1.

In the event that a tool string becomes lodged in a well during a wellbore operation and a decision is made to release the tool string from the wireline, detonation of the release tool 1 may be initiated at the surface by sending a specific, selective signal or series of signals to the detonator 50 in the release tool 1 to initiate detonation of explosive load 102. FIG. 11A shows a cross section of an embodiment of release tool 1 prior to detonation of the explosive load 102. Upon detonation of the detonator 50, the configuration of the release tool 1 functions to divert the energy, in the form of expanding gas, of the explosive load 102 to the radial vents 56 and thence to expansion chamber 84 to exert an axial force on latch 70. The axial force increases until the shear pins 76 are sheared. Shearing of shear pins 76 permits latch 70 to move axially and, thus, permits flanges 64 to disengage from connecting sleeve 11. The relaxing of fingers 60 permitted when connecting sleeve 11 is no longer exerting an outward radial force on them, permits tool string subassembly 2 and wireline subassembly 3 to disengage from one another. FIG. 11B shows a cross section of the release tool 1 immediately subsequent to the disengagement of the top surface 67 of the connecting sleeve 11 by the undersides 65 of each flange 64. Thus, tool string subassembly 2 is no longer positively engaged to wireline subassembly 3 and the two subassemblies will disengage from one another under minimal axial force.

As stated, the detonation of explosive load 102 will result in expanding gas filling a portion of the release tool 1 adjacent the detonator 50. The portions of release tool 1 into which expanding gas are directed are the unoccupied portions of central vent 54, radial vents 56 and expansion chamber 84. The total volume into which expanding gases are directed may be referred to as the expansion volume. The ratio of the expansion volume to the volume of the explosive load 102 of the release tool 1 may be approximately 200:1 or lower. According to an aspect, the ratio of expansion volume:explosive load volume may be approximately 100:1 or lower. According to another aspect, the ratio of expansion chamber:explosive volume may be approximately about 70:1 to about 80:1.

The detonative force generated by the detonation of the detonator may also cause o-rings 86 that sealed pressure channels 82 in outer housing 12 to move or reposition away from pressure channels 82. Once the pressure channels 82 are opened, fluid from the well floods into expansion chamber 84 in the interior of the release tool 1, substantially equalizing the pressure inside the release tool 1 relative to the pressure outside the release tool 1 in the well, which may allow the wireline subassembly to be pulled away from the tool string subassembly with only minimal tension. As such, the wireline release tool 1 herein can successfully release the tool string when the wireline cable is slack and no significant tension is loaded onto the wireline. This enables retrieval and recovery of the release tool 1 and any expensive non-expendable items above it, without putting significant tension on the wireline, thereby minimizing or preventing damage to electronic components attached to the wireline cable, allowing retrieved equipment to be readily reused in subsequent operations.

FIGS. 14A, 14B and 14C illustrate embodiments of a release tool 1 similar in most ways to the release tools described hereinabove. One significant change in the release tool 1 of FIGS. 14A, 14B and 14C involves the structure of the latch 70 and the expansion chamber 84. In earlier described embodiments, the expansion chamber 84 is axially adjacent the latch 70; an axial force may only be exerted on the bottom end of the latch 70. In the embodiment shown in FIGS. 14A, 14B and 14C, the outer surface of detonator housing 32 and the inner surface of latch 11 have been configured to enclose an expansion chamber 84. Latch 11 encloses a top end and radially outward side of the expansion chamber 84 while detonator housing 32 encloses a bottom end and radially inward side thereof. O-rings 72 between the inner surface of latch 11 and outer surface of detonator housing 32 seal expansion chamber 84. Radial vents 56 are located in detonator housing 32 to provide fluid connection from detonator 50 to the expansion chamber 84. Placing expansion chamber 84 between the latch 11 and detonator housing 32 allows for a substantial decrease in the volume of expansion chamber 84 as well as increased focus of the axial force on latch 11 resulting from expanding gas.

Although the expansion volume of the release tool 1 is essentially constant, i.e., a function of the dimensions of the release tool, the explosive load volume may be varied. One way of increasing the explosive load volume substantially is to extend central vent 54 to form an elongated vent 54*a*, as illustrated in FIG. 14B and FIG. 14C. In an embodiment, the elongated vent 54*a* accommodates a booster charge 57 (FIG. 14C) directly under the detonator 50. This booster charge 55 is detonated by the explosive load 102 of the detonator 50 and affords the opportunity to greatly increase the force exerted on latch 70 and shear pins 56.

Modified expansion chamber 84 of the release tool 1 embodiment illustrated in FIG. 14 allows for a substantial decrease in the expansion volume. As a direct result, the ratio of the expansion volume to the volume of the explosive load 102 may be lowered to approximately 10:1.

A separate removable fishing head 120 threadingly attached to detonator housing 32 is shown in FIG. 14. One function of the removable fishing head 120 is to ease connection of the latch 11 to detonator housing 32. After assembly of latch 11 onto detonator housing 32, fishing head 120 is threadingly attached to the detonator housing 32.

According to an aspect of the release tool 1 herein, fewer components are required as compared to other ballistic release tools currently available. Further, the optimized functioning of the release tool 1 allows for the ratio of volume inside the expansion chamber 84 to the volume the explosive load 102 is also optimized. As a result of these factors, the size of the release tool 1 herein can be as little as about 25 cm long and weigh as little as about 9 kg. Certain embodiments of the release tool 1 herein are from about 25 cm to about 90 cm.

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

In this specification and the claims that follow, reference will be made to terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of" Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A wireline release tool assembly, comprising:

a tool string subassembly comprising an outer housing having an upper end, a lower end, an inner chamber extending between the upper end and the lower end, and a plurality of tubing fingers extending from the upper end;

a wireline subassembly operably coupled to the tool string subassembly, the wireline subassembly comprising an outer housing comprising one or more receiving grooves formed on an interior surface of the outer housing, wherein the tubing fingers are received within the receiving grooves;

an energetic device housing positioned in the inner chamber of the tool string subassembly;

a connecting sleeve positioned at least in part between the outer housing of the wireline subassembly and the fingers; and a latch slidably disposed on an outer surface of the energetic device housing, wherein in a first position on the energetic device housing, the latch is in contact with the fingers and biases the fingers into the receiving grooves, the latch is moveable between the first position and a second position in response to an explosive force, and in the second position, the latch releases the fingers from the receiving grooves, such that the tool string subassembly is uncoupled from the wireline subassembly.

2. The release tool of claim 1, further comprising:

a detonator positioned in the energetic device housing, wherein the detonator is configured to generate the explosive force.

3. The release tool of claim 2, wherein the energetic device housing comprises:

a center bore;

a central vent extending downwardly from the center bore; and a radial vent extending in a radial direction from the central vent.

4. The release tool of claim 3, wherein the detonator is positioned in the center bore;

the detonator is configured to create the explosive force; and the central and radial vents define at least a portion of a path from the detonator to the latch.

5. The release tool of claim 4, further comprising:

a pressure channel extending through a sidewall of the outer housing of the wireline subassembly and open to each of an inner chamber of the wireline subassembly and an outside environment, wherein the inner chamber is sealed from the outside environment by the latch in the first position; and a shear pin disposed in the latch, wherein the latch is movable from the first position to the second position in response further to the explosive force shearing the shear pin, and the inner chamber is in fluid communication with the outside environment when the latch is in the second position.

6. The release tool of claim 1, further comprising:

a detonator in the energetic device housing, wherein the detonator is a wireless detonator.

7. The release tool of claim 1, further comprising:

an expansion chamber bounded by an external surface of the energetic device housing, wherein the ratio of free volume inside the expansion chamber to explosive volume is approximately 200:1 or less.

8. A wireline release tool assembly, comprising:

a tool string subassembly comprising an outer housing comprising a plurality of tubing fingers;

a wireline subassembly comprising an outer housing having an inner chamber and one or more receiving grooves formed in an interior surface of the outer housing, wherein the tubing fingers are received within the receiving grooves;

a detonator subassembly positioned in the tool string subassembly and at least partially extending into the inner chamber of the wireline subassembly, the detonator subassembly comprising an energetic device housing;

a latch slidably disposed on an outer surface of the energetic device housing;

a pressure channel extending through a sidewall of the outer housing of the wireline subassembly; and a shear pin disposed in the latch, wherein the latch is movable from a first position on the energetic device housing to a second position on the energetic device housing in response to an explosive force shearing the shear pin, in the first position on the energetic device housing, the latch is in contact with the fingers and biases the fingers into the receiving grooves, in the second position, the latch releases the fingers from the receiving grooves, such that the tool string subassembly is uncoupled from the wireline subassembly, and the inner chamber is in fluid communication with an outside environment external to the wireline release tool assembly when the latch is in the second position.

9. The release tool of claim 8, wherein the tool string subassembly includes a tool string engagement subassembly, and the wireline subassembly includes a wireline cable engagement subassembly.

10. The release tool of claim 8, further comprising:

a detonator positioned in the energetic device housing, wherein the detonator is configured to generate the explosive force.

11. The release tool of claim 10, wherein the energetic device housing further comprises:

a center bore;

a central vent extending downwardly from the center bore; and a radial vent extending in a radial direction from the central vent.

12. The release tool of claim 11, wherein the detonator is positioned in the center bore, and the central and radial vents define at least a portion of a path from the detonator to the latch.

13. The release tool of claim 12, further comprising:

a pressure channel extending through a sidewall of the outer housing of the wireline subassembly, wherein the latch is movable from the first position to the second position in response further to the explosive force shearing the shear pin, and the inner chamber is in fluid communication with the outside environment when the latch is in the second position.

14. The release tool of claim 8, further comprising:

a connecting sleeve positioned at least in part between the outer housing of the wireline subassembly and the fingers.

15. The release tool of claim 8, further comprising:

a detonator positioned in the energetic device housing, wherein the detonator is a wireless detonator.

16. The release tool of claim 8, further comprising:

an expansion chamber bounded by an external surface of the energetic device housing, wherein the ratio of free volume inside the expansion chamber to explosive volume is approximately 200:1 or less.

17. A wireline release tool assembly, comprising:

a tool string subassembly coupled to a perforating gun, the tool string subassembly comprising an outer housing having an upper end, a lower end, an inner chamber extending between the upper end and the lower end, and a plurality of tubing fingers extending from the upper end;

a connecting sleeve circumferentially disposed around the tubing fingers, a wireline subassembly operably coupled to the tool string subassembly, the wireline subassembly comprising an outer housing comprising one or more receiving grooves formed on an interior surface of the outer housing, wherein the tubing fingers are receivable within the receiving grooves;

an energetic device housing positioned in the inner chamber of the tool string subassembly; and a latch slidably disposed on an outer surface of the energetic device housing, wherein the connecting sleeve is positioned at least in part between the outer housing of the wireline subassembly and the fingers, and further wherein in a first position on the energetic device housing, the latch is in contact with the fingers and biases the fingers into the receiving grooves, the latch is moveable between the first position and a second position in response to an explosive force, and in the second position, the latch releases the fingers from the receiving grooves, such that the tool string subassembly is uncoupled from the wireline subassembly.

18. The release tool of claim 17, wherein the energetic device housing further comprises:

a center bore, a central vent extending downwardly from the center bore, and a radial vent extending in a radial direction from the central vent.

* * * * *